US009715186B2

(12) United States Patent
Sugama et al.

(10) Patent No.: US 9,715,186 B2
(45) Date of Patent: Jul. 25, 2017

(54) ELECTROSTATIC IMAGE DEVELOPING TONER

(71) Applicant: Konica Minolta, Inc., Tokyo (JP)

(72) Inventors: Kouji Sugama, Musashino (JP); Yohei Ohno, Hino (JP); Keisuke Asano, Hachioji (JP); Noboru Ueda, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/092,213

(22) Filed: Apr. 6, 2016

(65) Prior Publication Data

US 2016/0370722 A1 Dec. 22, 2016

(30) Foreign Application Priority Data

Jun. 17, 2015 (JP) ..... 2015-121640

(51) Int. Cl.
*G03G 9/08* (2006.01)
*G03G 9/087* (2006.01)

(52) U.S. Cl.
CPC ..... *G03G 9/08755* (2013.01); *G03G 9/08713* (2013.01)

(58) Field of Classification Search
CPC ..... G03G 9/08755; G03G 9/08713
USPC ..... 430/109.4, 109.3
See application file for complete search history.

(56) References Cited

U.S. PATENT DOCUMENTS

2011/0294062 A1* 12/2011 Eida ..... G03G 9/081 430/109.3

FOREIGN PATENT DOCUMENTS

| | | | |
|---|---|---|---|
| JP | 2005234046 | A | 9/2005 |
| JP | 2006251564 | A | 9/2006 |
| JP | 2010002893 | A | 1/2010 |
| JP | 2012181263 | A | 9/2012 |
| JP | 2015064566 | A | 4/2015 |

OTHER PUBLICATIONS

An Office Action including English translation dated Jun. 6, 2017 from corresponding Japanese Application No. 2015-121640 (10 pages).

* cited by examiner

*Primary Examiner* — Mark A Chapman
(74) *Attorney, Agent, or Firm* — Lucas & Mercanti, LLP

(57) ABSTRACT

Provided is an electrostatic image developing toner having toner mother particles containing a binder resin and a releasing agent, wherein the binder resin contains an amorphous vinyl resin and a crystalline polyester resin; the releasing agent contains a first releasing agent component containing an ester wax and a second releasing agent component containing a microcrystalline wax; a content of the first releasing agent component in the releasing agent is in the range of 40 to 98 mass %; a content of the second releasing agent component in the releasing agent is in the range of 2 to 60 mass %; and a content of the crystalline polyester resin in the binder resin is in the range of 5 to 20 mass %.

8 Claims, No Drawings

ELECTROSTATIC IMAGE DEVELOPING TONER

This application is based on Japanese Patent Application No. 2015-121640 filed on Jun. 17, 2015 with Japan Patent Office, the entire content of which is hereby incorporated by reference.

TECHNICAL FIELD

The present invention relates to an electrostatic image developing toner. More specifically, the present invention relates to an electrostatic image developing toner excellent in fixing-separation and uniform gloss while keeping low-temperature fixability and high-temperature offset resistivity.

BACKGROUND

In recent years, it has been required to decrease heat energy during the toner fixing process for the purpose of higher printing speed, expansion of usable paper types, and decrease of an environmental load. In order to decrease the heat energy during the toner fixing process, it is requested a technology enabling to improve low-temperature fixability of an electrostatic image developing toner (hereafter, it is simply called as "a toner"). As one of the achieving technologies, it is known a method to introduce a crystalline resin such as a crystalline polyester resin having a sharp-melting property in a binder resin.

For example, Patent document 1 (JP-A No. 2006-251564) discloses a toner having a binder resin which contains a crystalline polyester resin and an amorphous resin. By using a binder resin mixed with a crystalline polyester resin and an amorphous resin, the crystalline component of the crystalline polyester resin will be melted when the temperature of the heat fixing process is above the melting point of the crystalline polyester resin. This melted crystalline component will move into the amorphous resin component to result in promoting heat melting of the amorphous resin. Thus, it is possible to achieve low-temperature fixing.

However, the viscosity of the toner will be rapidly decreased by the presence of the crystalline polyester resin in the toner particles at the heat fixing process. As a result, the image formed with the melted toner will be broken, and a part of the image may be transferred to a fixing member (it is called as a high-temperature offset phenomenon), or it may produce a problem of fixing-separation failure in which an image support substrate is wound to the fixing member due to the lack of releasing property.

In order to solve the above-described problems, Patent document 2 (JP-A No. 2005-234046) discloses a toner using a crystalline polyester resin together with two or more kinds of releasing agents. According to the method disclosed in Patent document 2, the toner has: a core layer containing a crystalline polyester resin and two or more kinds of releasing agents having a different melting point; and a shell layer containing an amorphous polymer. It is said that this toner enables to achieve a wide range of temperature for separation and to achieve low-temperature fixing.

However, by an increased demand for expansion of usable paper types such as thin-paper handling, a sufficient fixing-separation property has not been ensured. Further, there is a problem in which crystalline sizes of the wax and the crystalline polyester resin are diverse, and this will induce deterioration of uniform glossiness and will generate gloss unevenness.

SUMMARY

The present invention was done based on the above-described situation. An object of the present invention is to provide an electrostatic image developing toner excellent in fixing-separation and uniform gloss while keeping low-temperature fixability and high-temperature offset resistivity.

The present inventors have investigated the reasons of the above-described situation to solve the above-described object of the present invention. It was fond to provide an electrostatic image developing toner excellent in fixing-separation and uniform gloss while keeping low-temperature fixability and high-temperature offset resistivity by the embodiments of the following electrostatic image developing toner. The inventive electrostatic image developing toner comprises toner particles which contain a binder resin and a releasing agent, wherein the binder resin contains an amorphous vinyl resin and a crystalline polyester resin, and the releasing agent contains a first releasing agent component containing an ester wax and a second releasing agent component containing a microcrystalline wax. The content of the first releasing agent component in the releasing agent, and the content of the second releasing agent component in the releasing agent are controlled to be in the specific range. The effects of the present invention were achieved by this electrostatic image developing toner.

The above-described object of the present invention can be solved by the following embodiments.

1. An electrostatic image developing toner comprising toner mother particles containing a binder resin and a releasing agent, wherein the binder resin contains an amorphous vinyl resin and a crystalline polyester resin;

the releasing agent contains: a first releasing agent component containing an ester wax; and a second releasing agent component containing a microcrystalline wax;

a content of the first releasing agent component in the releasing agent is in the range of 40 to 98 mass %;

a content of the second releasing agent component in the releasing agent is in the range of 2 to 60 mass %; and a content of the crystalline polyester resin in the binder resin is in the range of 5 to 20 mass %.

2. An electrostatic image developing toner of the embodiment 1, wherein a content of the amorphous vinyl resin in the binder resin is 50 mass % or more.

3. An electrostatic image developing toner of the embodiments 1 or 2, wherein a melting point ($T_{mc}$) of the crystalline polyester resin satisfies Relation (1).

$$65(°\ C.) \leq T_{mc} \leq 85(°\ C.) \quad \text{Relation (1):}$$

4. An electrostatic image developing toner of any one of the embodiments 1 to 3, wherein a melting point ($T_{mw1}$) of the first releasing agent component and a melting point ($T_{mw2}$) of the second releasing agent component satisfy Relation (2).

$$5(°\ C.) \leq T_{mw2} - T_{mw1} \leq 15(°\ C.) \quad \text{Relation (2):}$$

5. An electrostatic image developing toner of any one of the embodiments 1 to 4, wherein a melting point ($T_{mc}$) of the crystalline polyester resin and a melting point ($T_{mw2}$) of the second releasing agent component satisfy Relation (3).

$$5(°\ C.) \leq T_{mw2} - T_{mc} \leq 15(°\ C.) \quad \text{Relation (3):}$$

6. An electrostatic image developing toner of any one of the embodiments 1 to 5, wherein a content of the releasing agent in the toner mother particles is in the range of 3 to 15 mass %.

7. An electrostatic image developing toner of any one of the embodiments 1 to 6, wherein the first releasing agent component contains a plurality of ester compounds each having a different carbon chain length; and a content of the ester compound having a carbon chain length corresponding to a highest content in a distribution of the carbon chain length of the first releasing agent component is 70 mass % or more.

8. An electrostatic image developing toner of any one of the embodiments 1 to 7, wherein the crystalline polyester resin is a hybrid crystalline polyester resin having a chemical bond between a crystalline polyester resin unit and an amorphous resin unit other than a polyester resin.

9. An electrostatic image developing toner of the embodiment 8, wherein the amorphous resin unit is a vinyl resin unit.

By any one of the above-described embodiments of the present invention, it can provide an electrostatic image developing toner excellent in fixing-separation and uniform gloss while keeping low-temperature fixability and high-temperature offset resistivity.

A formation mechanism or an action mechanism of the effects of the present invention is not clearly identified, but it is supposed as follows.

A toner employing a mixture of an amorphous resin and a crystalline polyester resin has the following problems: a high-temperature offset phenomenon in which an image is broken due to a sudden decrease in viscosity of the toner particle during a heat fixing process; decrease of a fixing-separation property caused by a decreased speed of bleeding out of the wax; and gloss unevenness (decrease of uniform glossiness) due to variation of crystal size of the crystalline polyester resin.

In order to achieve a good balance between the low-temperature fixability and the high-temperature offset resistivity, it is efficient to incorporate an amorphous vinyl resin which will be not excessively decreased its elasticity at the moment of melted state, and a crystalline polyester resin excellent in low-temperature fixability.

Further, in the toner mother particles containing the amorphous vinyl resin and the crystalline polyester resin, when a releasing agent is composed of an ester wax and a microcrystalline wax, the crystal size of the wax and the crystalline polyester resin will become small and uniformity of the crystal size will become high during preparation of the toner, and these crystals are dispersed in the toner mother particles. This effect is supposed to be produced by the following reasons. In the matrix of the amorphous resin, the crystalline polyester resin, the ester wax and the microcrystalline wax are mutually interacted to result in winding around their molecular chains. Consequently, the crystallization speed will be increased and the growth of the crystals will be restrained. As a result, the crystalline polyester resin and the releasing agent are dispersed in the toner mother particles.

By the structure in which the crystal size of the crystalline polyester resin is small, and the crystalline polyester resin is uniformly dispersed in the toner mother particles, the crystalline polyester resin and the amorphous resin are rapidly together during the heat fixing process. This will promote heat melting of the amorphous resin to result in excellent low-temperature fixability. In addition, the releasing agent having a small crystal size and dispersed in a small size will be bled out on the surface of the toner image. This will lead to an excellent fixing-separation property.

Further, with plasticizing the amorphous resin by the presence of the crystalline polyester resin during the fixing process, the adhesion property is given to the image support by the ester wax. Consequently, an excellent low-temperature fixability can be obtained, and it is increased the oozing speed of the releasing agent composed of the ester wax and the microcrystalline wax to the surface of the image. Thus, it is assumed that the fixing-separation property is improved.

Moreover, in the image after heat fixing process, since the crystal size of the crystalline polyester resin and the wax become small, and the uniformity of the crystal size becomes high, it is assumed that it can be obtained an image of excellent quality of high gloss uniformity without gloss unevenness.

DESCRIPTION OF THE PREFERRED EMBODIMENTS

An electrostatic image developing toner of the present invention is characterized in containing toner mother particles which contain a binder resin and a releasing agent, wherein the binder resin contains an amorphous vinyl resin and a crystalline polyester resin; the releasing agent contains a first releasing agent component containing an ester wax and a second releasing agent component containing a microcrystalline wax; a content of the first releasing agent component in the releasing agent is in the range of 40 to 98 mass %; a content of the second releasing agent component in the releasing agent is in the range of 2 to 60 mass %; and a content of the crystalline polyester resin in the binder resin is in the range of 5 to 20 mass %. The above-described technical feature is common to the embodiments 1 to 9 of the present invention.

As the embodiments of the present invention, it is preferable that the content of the amorphous vinyl resin in the binder resin is 50 mass % or more. By this, it is possible that the elasticity at the melted state is not decreased excessively. By incorporating the amorphous vinyl resin excellent in high-temperature offset resistivity, and the crystalline polyester resin excellent in low-temperature fixability, it is possible to achieve a good balance between low-temperature fixability with high-temperature offset resistivity.

It is preferable that the melting point ($T_{mc}$) of the crystalline polyester resin satisfies the above-described Relation (1) from the viewpoint of improvement in low-temperature fixability, high-temperature offset resistivity, and thermal storage resistivity.

It is preferable that the melting point ($T_{mw1}$) of the first releasing agent component and the melting point ($T_{mw2}$) of the second releasing agent component satisfy the above-described Relation (2). By this, the crystal size of the different melting point releasing agent made of the first releasing agent component and the second releasing agent component becomes small during preparation of the toner, and the releasing agent can be easily dispersed in the toner mother particles. As a result, generation of gloss unevenness may be restrained, and it can be effectively obtained improved adhesiveness by the first releasing agent component, and improved separation of the releasing agent as a whole.

It is preferable that the melting point ($T_{mc}$) of the crystalline polyester resin and the melting point ($T_{mw2}$) of the second releasing agent component satisfy the above-described Relation (3). By this, the crystal size of the crystalline polyester resin becomes small during preparation of the toner, and it can be easily dispersed in the toner mother particles. Further, generation of gloss unevenness may be restrained, and since the crystalline polyester resin will promote the heat melting of the amorphous resin during the heat fixing process, the toner becomes excellent in low-temperature fixability.

It is preferable that the content of the releasing agent in the toner mother particles is in the range of 3 to 15 mass % from the viewpoint of achieving excellent fixing-separation property and restraining generation of gloss unevenness.

It is preferable that the first releasing agent component contains a plurality of ester compounds each having a different carbon chain length; and the content of the ester compound having a carbon chain length corresponding to a highest content in a distribution of the carbon chain length of the first releasing agent component is 70 mass % or more.

It is preferable that the crystalline polyester resin is a hybrid crystalline polyester resin having a chemical bond between a crystalline polyester resin unit and an amorphous resin unit other than a polyester resin. When a hybrid crystalline polyester resin is used, the affinity between the main binder and the crystalline polyester resin is increased. Consequently, the dispersing property of the crystalline polyester resin in the toner mother particles becomes excellent. It can be obtained a large effect of low-temperature fixability with keeping high-temperature offset resistivity.

It is preferable that the amorphous resin unit is a vinyl resin unit. By incorporating the same kind of resin component as the amorphous vinyl resin in the crystalline polyester resin, the crystalline polyester resin will melt the amorphous resin during the fixing process. As a result, the toner is excellent in low-temperature fixability. Further, since the crystal growth of the crystalline polyester resin is restrained, the crystals will be dispersed to result in inhibiting generation of gloss unevenness.

The present invention and the constitution elements thereof, as well as configurations and embodiments, will be detailed in the following. In the present description, when two figures are used to indicate a range of value before and after "to", these figures are included in the range as a lowest limit value and an upper limit value.

<<Electrostatic Image Developing Toner>>

An electrostatic image developing toner of the present invention contains toner mother particles having at least a binder resin and a releasing agent.

It is preferable that the electrostatic image developing toner of the present invention has a softening point in the range of 80 to 140° C. More preferably, it is in the range of 90 to 120° C.

By making the softening point in the above-described range, it can reduce the harmful effect produced by the heat given during the fixing process. As a result, since it can form an image without giving an excessive burden to the coloring agent, the produced visible image can obtain wide and stable color reproduction ability. Moreover, since an extremely low-temperature fixing can be done without a harmful effect, it is possible to perform image production with a small load to the environment by realizing reduction of electric power consumption.

The softening point of the electrostatic image developing toner of the present invention can be made by one of the following methods or by combination thereof: (1) adjusting the kinds and the composition ratio of the polymerizable monomers to obtain the binder resin; (2) adjusting the molecular weight of the resin by controlling the kind and the amount of the chain transfer agent for obtaining the binder resin during the production process of the toner; and (3) adjusting the kind and the amount of the composition materials such as a releasing agent.

The softening point of an electrostatic image developing toner of the present invention may be measured by using, for example, Flow Tester CFT-500 (produced by Shimazu Seisakusho Co., Ltd.). Specifically, a sample which is molded to a 10 mm high column is compressed by a plunger at a load of $1.96\times10^6$ Pa with heating at a temperature rising rate of 6° C./min and extruded from a long nozzle having a diamante of 1 mm and a length of 1 mm, whereby, a curve (softening flow curve) between an amount of plunger-drop and temperature is drawn. The temperature corresponding to 5 mm drop is defined as the softening temperature.

Each material for composing the electrostatic image developing toner of the present invention will be described.

<Toner Mother Particle>

The toner mother particle of the present invention is composed of at least a binder resin and a releasing agent.

In the present invention, "toner particles" designate "toner mother particles added with an external additive". An aggregate of toner particles or toner mother particles is called as a toner. The toner mother particles can be generally used as toner particles without any change. However, in the present invention, toner mother particles added with an external additive are used as toner particles.

<Releasing Agent>

The releasing agent of the present invention contains a first releasing agent component containing an ester wax and a second releasing agent component containing a microcrystalline wax. It is characterized that: a content of the first releasing agent component in the releasing agent is in the range of 40 to 98 mass %; and a content of the second releasing agent component in the releasing agent is in the range of 2 to 60 mass %.

When the content of the first releasing agent component is smaller than 40 mass %, the low-temperature fixability will be deteriorated, and when the content of the first releasing agent component is larger than 98 mass %, the gloss unevenness will be further worsened When the content of the second releasing agent component is smaller than 2 mass %, the gloss unevenness will be further worsened, and when the content of the second releasing agent component is larger than 60 mass %, the low-temperature fixability will be deteriorated.

It is more preferable that the content of the first releasing agent component and the content of the second releasing agent component each respectively are in the range of 70 to 96 mass % and in the range of 4 to 30 mass %. It is further preferable that the first releasing agent component is in the range of 80 to 96 mass %, and the second releasing agent component is in the range of 4 to 20 mass %.

It is preferable that a melting point ($T_{mw1}$) of the first releasing agent component and a melting point ($T_{mw2}$) of the second releasing agent component satisfy the following Relation (2).

$$5(°\ C.)\leq T_{mw2}-T_{mw1}\leq 15(°\ C.) \quad \text{Relation (2):}$$

It is more preferable that the difference of the melting points of the first and the second releasing agent components ($T_{mw2}-T_{mw1}$) is in the range of 10 to 15° C.

It is preferable that the melting point ($T_{mc}$) of the crystalline polyester resin described later and the melting point ($T_{mw2}$) of the second releasing agent component satisfy the following Relation (3).

$$5(°\ C.)\leq T_{mw2}-T_{mc}\leq 15(°\ C.) \quad \text{Relation (3):}$$

In the present invention, the melting points derived from the first and the second releasing agent components and the crystalline polyester resin can be obtained from DSC measurement of the toner (DSC: Differential Scanning Calorimetry). The differential scanning calorimetry of the toner is conducted by using a "Diamond DSC" (PerkinElmer Inc.), for example.

The measurement is done as follows. A sample is subjected to a first heating step of raising the temperature from room temperature (25° C.) to 150° C. at a heating rate of 10° C./min and holding the temperature at 150° C. for 5 minutes, a cooling step of decreasing the temperature from 150° C. to 0° C. at a cooling rate of 10° C./min and holding the temperature at 0° C. for 5 minutes, and a second heating step of raising the temperature from 0° C. to 150° C. at a heating rate of 10° C./min in the written order. Regarding the measuring process, 3.0 mg of the toner is sealed in an aluminum pan and it is placed in a sample holder of the "Diamond DSC". An empty aluminum pan is used for a reference.

In the above-described measurement, an endothermic curve obtained during the first heating step is analyzed. The top temperature in the endothermic peaks derived from the first and the second releasing agent components and the crystalline polyester resin, is determined as a melting point (° C.).

(First Releasing Agent Component)

An ester wax contained in the first releasing agent component contains at least an ester.

Usable examples of an ester are any one of a monoester, a diester, a triester, and a tetraester. Specific examples of an ester are: esters made of a higher fatty acid and a higher alcohol represented by Formulas (1) to (3); trimethylolpropane triesters represented by Formula (4); glycerol triesters represented by Formula (5); and pentaerythritol tetraester represented by Formula (6).

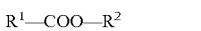
Formula (1):

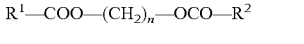
Formula (2):

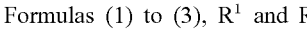
Formula (3):

In Formulas (1) to (3), $R^1$ and $R^2$ each independently represent a non-substituted or a substituted hydrocarbon group having 13 to 30 carbon atoms, provided that $R^1$ and $R^2$ each may be the same or different. A suffix "n" represents an integer of 1 to 30.

$R^1$ and $R^2$ each represent a hydrocarbon group having 13 to 30 carbon atoms, and preferably, they represent a hydrocarbon group having 17 to 22 carbon atoms.

A suffix "n" represents an integer of 1 to 30, and preferably it represents an integer of 1 to 12.

Formula (4)

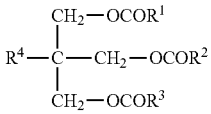

In Formula (4), $R^1$ to $R^4$ each independently represent a non-substituted or a substituted hydrocarbon group having 13 to 30 carbon atoms, provided that $R^1$ to $R^4$ each may be the same or different.

$R^1$ to $R^4$ each represent a hydrocarbon group having 13 to 30 carbon atoms, and preferably, preferably they represent a hydrocarbon group having 17 to 22 carbon atoms.

Formula (5)

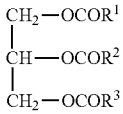

In Formula (5), $R^1$ to $R^3$ each independently represent a non-substituted or a substituted hydrocarbon group having 13 to 30 carbon atoms, provided that $R^1$ to $R^3$ each may be the same or different.

$R^1$ to $R^3$ each represent a hydrocarbon group having 13 to 30 carbon atoms, and preferably, preferably they represent a hydrocarbon group having 17 to 22 carbon atoms.

Formula (6)

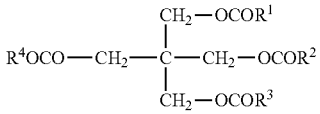

In Formula (6), $R^1$ to $R^4$ each independently represent a non-substituted or a substituted hydrocarbon group having 13 to 30 carbon atoms, provided that $R^1$ to $R^4$ each may be the same or different.

$R^1$ to $R^4$ each represent a hydrocarbon group having 13 to 30 carbon atoms, and preferably they represent a hydrocarbon group having 17 to 22 carbon atoms.

A substituent which may be possessed by $R^1$ to $R^4$ is not limited in particular as long as it does not inhibit the effect of the present invention. Examples of the substituent include: a straight or branched chain alkyl group, an alkenyl group, an alkynyl group, an aromatic hydrocarbon ring group, an aromatic heterocyclic groups, a non-aromatic hydrocarbon ring group, a non-aromatic heterocyclic group, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, an acyl group, an acyloxy group, an amide group, a carbamoyl group, a ureido group, a sulfinyl group, an alkylsulfonyl group, an arylsulfonyl group or a heteroarylsulfonyl group, an amino group, a halogen atom, a fluorinated hydrocarbon group, a cyano group, a nitro group, a hydroxy group, a thiol group, a silyl group, and a deuterium atom.

Specific examples of a monoester represented by Formula (1) are the following compounds represented by Formulas (1-1) to (1-8).

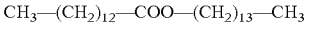
Formula (1-1):

Formula (1-2):

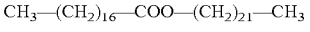
Formula (1-3):

Formula (1-4):

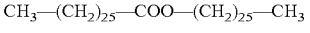
Formula (1-5):

Formula (1-6):

Formula (1-7):

Formula (1-8):

Specific examples of a diester represented by one of Formulas (2) and (3) are the following compounds represented by Formulas (2-1) to (2-7), and (3-1) to (3-3).

$CH_3—(CH_2)_{20}—COO—(CH_2)_4—OCO—(CH_2)_{20}—CH_3$ Formula(2-1):

$CH_3—(CH_2)_{18}—COO—(CH_2)_4—OCO—(CH_2)_{18}—CH_3$ Formula (2-2):

$CH_3—(CH_2)_{20}—COO—(CH_2)_2—OCO—(CH_2)_{20}—CH_3$ Formula (2-3):

$CH_3—(CH_2)_{22}—COO—(CH_2)_2—OCO—(CH_2)_{22}—CH_3$ Formula (2-4):

$CH_3—(CH_2)_{16}—COO—(CH_2)_4—OCO—(CH_2)_{16}—CH_3$ Formula (2-5):

$CH_3—(CH_2)_{26}—COO—(CH_2)_2—OCO—(CH_2)_{26}—CH_3$ Formula (2-6):

$CH_3—(CH_2)_{20}—COO—(CH_2)_6—OCO—(CH_2)_{20}—CH_3$ Formula (2-7):

$CH_3—(CH_2)_{21}—OCO—(CH_2)_6—COO—(CH_2)_{21}—CH_3$ Formula (3-1):

$CH_3—(CH_2)_{23}—OCO—(CH_2)_6—COO—(CH_2)_{23}—CH_3$ Formula (3-2):

$CH_3—(CH_2)_{19}—OCO—(CH_2)_6—COO—(CH_2)_{19}—CH_3$ Formula (3-3):

Specific examples of a triester represented by Formula (4) are the following compounds represented by Formulas (4-1) to (4-6).

Formula (4-1)

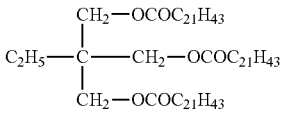

Formula (4-2)

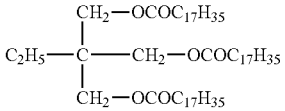

Formula (4-3)

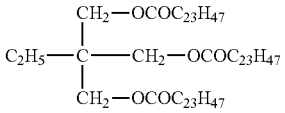

Formula (4-4)

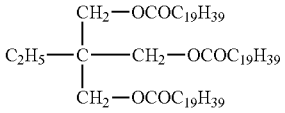

Formula (4-5)

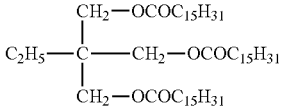

Formula (4-6)

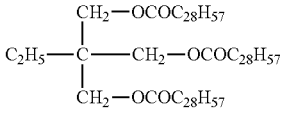

Specific examples of a triester represented by Formula (5) are the following compounds represented by Formulas (5-1) to (5-6).

Formula (5-1)

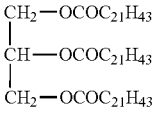

Formula (5-2)

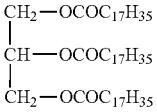

Formula (5-3)

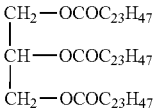

Formula (5-4)

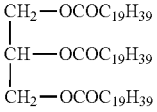

Formula (5-5)

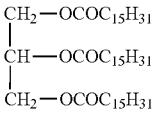

Formula (5-6)

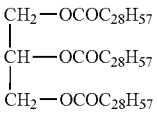

Specific examples of a tetraester represented by Formula (6) are the following compounds represented by Formulas (6-1) to (6-5).

Formula (6-1)

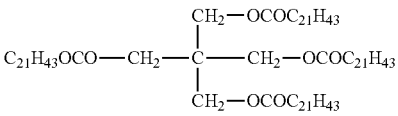

Formula (6-2)

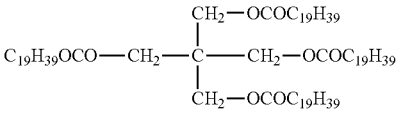

Formula (6-3)

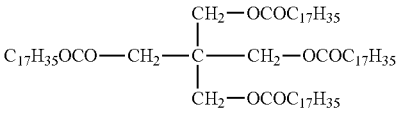

Formula (6-4)

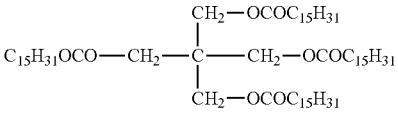

-continued

Formula (6-5)

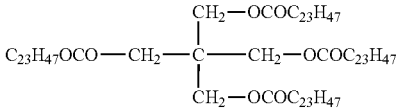

Among these compounds, preferable compounds are a monoester. An ester wax constituting the first releasing agent component may have a structure which is provided with a plurality of ester structures of a monoester, a diester, a triester and a tetraester in one molecule. As a first releasing agent component composing a releasing agent, a mixture of two or more kinds of esters can be used.

It is preferable that a content of the releasing agent in the toner mother particles is in the range of 3 to 15 mass %. More preferably, it is in the range of 5 to 12 mass %.

When the first releasing agent component contains a plurality of ester compounds each having a different carbon chain length, a content of the ester compound having a carbon chain length corresponding to a highest content in a distribution of the carbon chain length of the first releasing agent component is 70 mass % or more. More preferably, it is 80 mass % or more (Second Releasing Agent Component)

The second releasing agent component according to the present invention contains at least a microcrystalline wax. "Microcrystalline waxes", as described herein, refer to those which differ from paraffin waxes in which the major component is straight-chain hydrocarbon (normal paraffin) and in which the ratio of branched-chain hydrocarbon (isoparaffin) and ring hydrocarbon (cycloparaffin) is greater. Generally, since the microcrystalline waxes incorporate a large amount of low crystalline isoparaffin and cycloparaffin, crystals are smaller than paraffin waxes, while the molecular weight thereof is greater than paraffin waxes.

The microcrystalline waxes have: the number of carbons of 30 to 60; the weight average molecular weight of 500 to 800; and the melting point of 60 to 90° C. As the microcrystalline waxes constituting the branched hydrocarbon waxes, preferred are those of a weight average molecular weight of 600 to 800, and a melting point of 60 to 85° C. Further preferred are those of a lower molecular weight, specifically more preferred are those of a number average molecular weight of 300 to 1,000, still further preferred are those of the number average molecular weight of 400 to 800. Further, it is preferable that the ratio of the weight average molecular weight to the number average molecular weight (Mw/Mn) is in the range of 1.01 to 1.20.

Examples of a microcrystalline wax of the present invention include: HNP-0190, Hi-Mic-1045, Hi-Mic-1070, Hi-Mic-1080, Hi-Mic-1090, Hi-Mic-2045, Hi-Mic-2065, and Hi-Mic-2095, as well as WAX EMW-0001 and EMW-0003 in which isoparaffin is a major component, all produced by Nippon Seiro Co., Ltd.

It is preferable that the microcrystalline wax of the present invention has a branched ratio in the range of 0.1 to 20%, and more preferably in the range of 0.3 to 10%.

By regulating the branched ratio, namely, the ratio of total tertiary and quaternary carbon atoms to total carbon atoms constituting the branched hydrocarbon based wax to the range of 0.1 to 20%, even though the aforesaid branched hydrocarbon wax exhibits a low melting point, intermolecular tangle caused by interaction between the ester wax is assured to enable minimal generation of transfer to the surface of the toner mother particle of the releasing agent.

The branched ratio refers to a value which can be determined via the spectrum obtained by the $^{13}$C-NMR measurement using the following Relation (i).

$$\text{Branched ratio (\%)}=(C3+C4)/(C1+C2+C3+C4)\times 100 \qquad \text{Relation (i):}$$

In the above Relation (i), C1 represents the peak area according to the primary carbon atom, and C2 represents the peak area according to the secondary carbon atom, C3 represents the peak area according to the tertiary carbon atom, and C4 represents the peak area according to the quaternary carbon atoms.

(Conditions of $^{13}$C-NMR Measurement Method)

Measuring apparatus: FT NMR apparatus LAMBDA400 (made by JEOL Ltd.)

Measurement frequency: 100.5 MHz

Pulse condition: 4.0 μs

Data points: 32,768

Delayed time: 1.8 second

Frequency range: 27,100 Hz

Integration repetition: 20,000 times

Measurement temperature: 80° C.

Solvents: benzene-$d^6$/o-dichlorobenzene-$d^4$=1/4 (v/v)

Sample concentration: 3 mass %

Sample tube: Φ5 mm

Measurement mode: $^1$H perfect decoupling method

<Binder Resin>

The binder resin according to the present invention contains at least an amorphous vinyl resin and a crystalline polyester resin.

(Amorphous Vinyl Resin)

The amorphous vinyl resin according to the present invention is formed with a monomer having a vinyl group (it is called as "a vinyl monomer"). As an amorphous vinyl resin, it can be cited: a styrene-acrylic resin, a styrene resin, and an acrylic resin. Among them, a styrene-acrylic resin is preferably used.

In the present invention, an amorphous vinyl resin refers to a resin that does not exhibit any clear endothermic peak in an endothermic curve obtained by measurement with differential scanning calorimetry (DSC). Here, "a clear endothermic peak" designates a peak having a half bandwidth within 15° C. in an endothermic curve obtained by measurement with differential scanning calorimetry (DSC) under the condition of a temperature raising rate of 10° C./min. The endothermic curve can be measured with a differential scanning calorimeter "Diamond DSC" (PerkinElmer Inc.), for example.

Specific examples of a polymerizable vinyl monomer are cited below.

(1) Styrene monomers: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene.

(2) (Meth)acrylic acid ester monomers: methyl (meth)acrylate, ethyl (meth)acrylate, n-butyl (meth)acrylate, iso-propyl (meth)acrylate, iso-butyl (meth)acrylate, t-butyl (meth)acrylate, n-octyl (meth)acrylate, 2-ethylhexyl (meth)acrylate, stearyl (meth)acrylate, lauryl(meth)acrylate, phenyl (meth) acrylate, diethylaminoethyl (meth)acrylate and dimethylaminoethyl (meth)acrylate, and derivatives of these monomers.

(3) Vinyl esters: vinyl propionate, vinyl acetate and vinyl benzoate.

(4) Vinyl ethers: vinyl methyl ether and vinyl ethyl ether.

(5) Vinyl ketones: vinyl methyl ketone, vinyl ethyl ketone and vinyl hexyl ketone.

(6) N-vinyl compounds: N-vinyl carbazole, N-vinyl indole and N-vinyl pyrrolidone.

(7) Others: vinyl compounds such as vinylnaphthalene and vinylpyridine; acrylic acid or methacrylic acid derivatives such as acrylonitrile, methacrylonitrile and acrylamide.

The above-described vinyl monomers may be used alone or may be used in combination of two or more kinds.

It is preferable to use vinyl monomers containing ionic-dissociative group such as a carboxy group, a sulfonic acid group or a phosphoric acid group.

Examples of a monomer containing a carboxy group care: acrylic acid, methacrylic acid, maleic acid, itaconic acid, cinnamic acid, fumaric acid, monoalkyl maleate, and monoalkyl itaconate.

Examples of a monomer containing a sulfonic acid group are: styrenesulfonic acid, allylsulfosuccinic acid, 2-acrylamido-2-methylpropanesulfonic acid.

An example of a monomer containing a phosphoric acid group is acid phosphooxyethyl methacrylate.

Further, the vinyl monomers may be changed into a cross-linked resin by using poly-functional vinyl compounds.

Examples of a poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

The content of the amorphous vinyl resin in the binder resin is preferably 50 mass % or more, more preferably, it is 70 mass % or more.

(Crystalline Polyester Resin)

A content of the crystalline polyester resin of the present invention is characterized in being in the range of 5 to 20 mass % in the binder resin. When the content of the crystalline polyester resin is smaller than 5 mass %, the low-temperature fixability will be deteriorated, and when the content of the crystalline polyester resin is larger than 20 mass %, the gloss unevenness will be further worsened It is more preferable that the content of the crystalline polyester resin is in the range of 7 to 15 mass %.

It is preferable that a melting point ($T_{mc}$) of the crystalline polyester resin satisfies the following Relation (1).

$$65(^\circ\text{ C.}) \leq T_{mc} \leq 85(^\circ\text{ C.}) \qquad \text{Relation (1):}$$

It is more preferable that the melting point ($T_{mc}$) of the crystalline polyester resin is in the range of 70 to 80° C.

In addition, the melting point of the crystalline polyester resin may be measured by performing a DSC (Differential Scanning Calorimetry) measurement to the toner as described above.

The crystalline polyester resin according to the present invention can be obtained by a polycondensation reaction between an alcohol of a divalent or more (a polyhydric alcohol component) and a carboxylic acid of a divalent or more (a polycarboxylic acid component).

In the present invention, "a crystalline resin" indicates a resin which exhibits a clear endothermic peak during temperature rising in an endothermic curve obtained with DSC. Here, "a clear endothermic peak" designates a peak having a half bandwidth within 15° C. in an endothermic curve obtained by measurement with differential scanning calorimetry (DSC) under the condition of a temperature raising rate of 10° C./min.

The crystalline polyester resin according to the present invention is not limited in particular as long as it has a structural feature as described above. For example, the crystalline polyester resin may be a single polymer produced by a polycondensation reaction of a polyhydric alcohol component and a polycarboxylic acid component. Or it may be a hybrid crystalline polyester resin being a copolymer between a crystalline polyester resin unit, which is produced by a polycondensation reaction of a polyhydric alcohol component and a polycarboxylic acid component, and an amorphous resin unit other than a polyester resin. It is preferable to use a hybrid crystalline polyester resin.

As a hybrid crystalline polyester resin, it can be cited: a resin having a structure of a main chain of a crystalline polyester resin unit copolymerized with other component; a resin having a structure of a main chain of other component copolymerized with a crystalline polyester resin unit.

Examples of a polyhydric alcohol component are: divalent alcohols such as ethylene glycol, propylene glycol, butanediol, diethylene glycol, hexanediol, cyclohexanediol, octanediol, decanediol, dodecanediol, ethylene oxide adduct of bisphenol A, and propylene oxide adduct of bisphenol A; polyoles having three valent or more such as glycerin, pentaerythritol, hexamethylolmelamine, hexaethylmelamine, tetramethylol benzoguanamine, and tetraethylol benzoguanamine; and esters and hydroxycarboxylic acid derivatives of these compounds.

Examples of a polycarboxylic acid component are: divalent polycarboxylic acids such as oxalic acid, succinic acid, maleic acid, mesaconic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydrophthalic terephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acid, p-phenylene diacetic acid, m-phenylene diglycolic acid, p-phenylene diglycolic acid, o-phenylene diglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracene dicarboxylic acid, and dodecenylsuccinic acid; carboxylic acids of three or more valent such as trimellitic acid, pyromellitic acid, naphthalene tricarboxylic acid, naphthalene tetracarboxylic acid, pyrenetricarboxylic acid, and pyrenetetracarboxylic acid; and alkyl esters, acid anhydrides and acid chloride of these compounds.

The preparation method of the crystalline polyester resin is not limited in particular. It may be produced by polycondensation (esterification) of the above-described polyhydric alcohol component and the polycarboxylic acid component with a known esterification catalyst.

Regarding the ratio of the polycarboxylic acid and the polyhydric alcohol, it is preferred that the stoichiometric ratio of the hydroxy groups (OH) of the polyhydric alcohol to the carboxy groups (COOH) of the polycarboxylic acid is from 1.5/1 to 1/1.5, more preferably from 1.2/1 to 1/1.2.

Usable catalysts for producing a crystalline polyester resin of the present invention are: alkali metal compounds made of sodium and lithium; alkali earth metal compounds made of magnesium and calcium; metal compounds made of metals such as aluminum, zinc, manganese, antimony, titanium, tin, zirconium, and germanium; phosphorous acid compounds, phosphoric acid compounds, and amine compounds.

Specific examples of a tin compound are: dibutyltin oxide, tin octylate, tin dioctylate, and salts thereof.

Specific examples of a titanium compound are: titanium alkoxides such as tetra-n-butyl titanate, tetraisopropyl titanate, tetramethyl titanate, and tetrastearyl titanate; titanium acylates such as polyhydroxy titanium stearate; and titanium chelates titanium tetraacetylacetonate, titanium lactate, and titanium triethanolaminate.

A specific example of a germanium compound is germanium dioxide.

Specific examples of an aluminum compound are: and oxide such as poly aluminum hydroxide, aluminum alkoxide, and tributyl aluminate.

These compounds may be used alone or in combination of two or more kinds.

The polymerization temperature and the polymerization time are not limited in particular. The inside pressure of the reaction system may be reduced when needed.

When the crystalline polyester resin is a hybrid crystalline polyester resin made by copolymerization of a crystalline polyester resin unit and an amorphous resin unit, a content of the crystalline polyester resin unit is preferably in the range of 50 mass % or more to less than 98 mass % with respect to the total amount of the hybrid crystalline polyester resin. By making the content in the above-described range, it is possible to give a sufficient crystalline property to the hybrid crystalline polyester resin. The content of each component unit in the hybrid crystalline polyester resin may be determined with an NMR measurement or a measurement of P-GC/MS of a methylation reaction, for example.

Although the hybrid crystalline polyester resin of the present invention may be any form of a block copolymer or a graft copolymer as long as it contains both of a crystalline polyester resin unit and an amorphous resin unit, preferable is a graft copolymer. When the hybrid crystalline polyester resin is a graft copolymer, it is easy to control the orientation of the crystalline polyester resin unit. Consequently, it is possible to give a sufficient crystalline property to the hybrid crystalline polyester resin.

It is preferable that a crystalline polyester resin unit is grafted to a main chain of an amorphous resin unit other than a polyester resin. Namely, it is preferable that the hybrid crystalline polyester resin is a graft copolymer containing an amorphous resin unit other than a polyester resin as a main chain and a crystalline polyester resin unit as a side chain.

By making the above-described form, it can increase the orientation of the crystalline polyester resin unit. As a result, it is possible to improve the crystalline property of the hybrid crystalline polyester resin.

In addition, the hybrid crystalline polyester resin may further include a substituent such as a sulfonic acid group, a carboxy group or a urethane group. The inclusion of the above-described group may be in the crystalline polyester resin unit or in the amorphous resin unit other than a polyester resin, which will be described later.

It is preferable that the number of carbon atoms in the polyhydric alcohol (C(alcohol)) and the number of carbon atoms in the polycarboxylic acid (C(acid)) satisfy the following relations (A) to (C).

$$C(acid)-C(alcohol)\geq 4 \quad \text{Relation (A):}$$

$$C(acid)\geq 10 \quad \text{Relation (B):}$$

$$C(alcohol)\leq 6 \quad \text{Relation (C):}$$

The crystalline polyester resin specified by the carbon number of the raw material is formed by using a polyhydric alcohol and a polycarboxylic acid each having a different main chain length. As a result, the crystalline polyester resin has a structure in which a branched chain of a small carbon number and a branched chain of a large carbon number are bonded alternatively to the polyester chain. Consequently, it is assumed that there is a portion having low regularity when crystallization is formed. For this reason, by using the crystalline polyester resin specified by the carbon number of the raw material as a crystalline polyester resin for constituting the binder resin, the portion having low regularity in the crystalline will be sequentially melted when heat energy of higher temperature than the melting point of the crystalline polyester resin is given during the heat fixing process. As a result, it can obtain excellent low-temperature fixability.

Although it is preferable that Relation (A): C(acid)−C(alcohol)≥4 is satisfied, it is more preferable that: C(acid)−C(alcohol)≥6.

When two or more polycarboxylic acids are contained, the above-described C(acid) indicates a carbon number of the polycarboxylic acid component which is contained in the largest content (mol conversion). When the content is the same, the carbon number of the polycarboxylic acid component having the largest carbon number is taken as C(acid).

In the same manner, when two or more polyhydric alcohols are contained, the above-described C(alcohol) indicates a carbon number of the polyhydric alcohol component which is contained in the largest content (mol conversion). When the content is the same, the carbon number of the polyhydric alcohol component having the largest carbon number is taken as C(alcohol).

(Amorphous Resin Unit Other than Polyester Resin)

The amorphous resin unit other than the polyester resin is a portion derived from the amorphous resin unit other than the above-described crystalline polyester resin.

In addition, the amorphous resin unit does not exhibit a melting point when a DSC measurement is done to the resin having the same chemical structure and molecular weight as the above-described amorphous resin unit. The amorphous resin unit of the present invention is a resin unit having a relatively high glass transition temperature (Tg).

The amorphous resin unit of the present invention is not limited in particular as long as it has the above-described structure. For example, a resin having a structure containing a main chain of an amorphous resin unit copolymerized with other component, or a resin having a structure containing a main chain of other component copolymerized with an amorphous resin unit is within the hybrid crystalline polyester resin of the preset invention as long as the toner contains a resin having an amorphous resin segment as described above.

It is preferable that the amorphous resin unit of the present invention is the same kind of resin as the amorphous vinyl resin which is included in the binder resin. By making this embodiment, the affinity of the hybrid crystalline polyester resin and the amorphous vinyl resin will be improved. As a result, the hybrid crystalline polyester resin will be more easily incorporated in the amorphous vinyl resin, and electric-charging uniformity will be further improved.

Here, "the same kind of resin" indicates the resin in which a characteristic chemical bond is commonly included in the repeating unit. The meaning of "the characteristic chemical bond" is determined by "polymer classification" indicated in a database provided by National Institute for Material Science (NIMS): (http://polymer.nims.go.jp/PoLyInfo/guide/jp/term_polymer.html). Namely, the chemical bonds which constitute the following 22 kinds of polymers are called as "the characteristic chemical bonds": polyacryls, polyamides, polyacid anhydrides, polycarbonates, polydienes, polyesters, poly-halo-olefins, polyimides, polyimines, polyketones, polyolefins, polyethers, polyphenylenes, polyphosphazenes, polysiloxanes, polystyrenes, polysulfides, polysulfones, polyurethanes, polyureas, polyvinyls and other polymers.

"The same kind of resins" for the copolymer resins indicates resins having a common characteristic chemical bond in the chemical structure of a plurality of monomers which constitute the copolymer, when the copolymer has the monomers including the above-described chemical bonds as constituting units. Consequently, even if the resins each have a different property with each other, and even if the resins each have a different molar ratio of the monomers which constitute the copolymers, the resins are considered to be the same kind of resins as long as they contain a common characteristic chemical bond.

For example, the resin (or the resin unit) formed with styrene, butyl acrylate and acrylic acid and the resin (or the resin unit) formed with styrene, butyl acrylate and methacrylic acid both have at least a chemical bond constituting polyacrylate. Therefore, these two resins are the same kind of resins. Further examples are as follows. The resin (or the resin unit) formed with styrene, butyl acrylate and acrylic acid and the resin (or the resin unit) formed with styrene, butyl acrylate, acrylic acid, terephthalic acid, and fumaric acid both have at least a chemical bond constituting polyacrylate. Therefore, these two resins are also the same kind of resins.

It is not limited in particular the resin component that constitutes the amorphous resin unit. Examples thereof are: vinyl resin unit, urethane resin unit, and urea resin unit. Among them, the vinyl resin unit is preferably used, because it can easily control the thermoplastic property.

As a vinyl resin unit, any units formed by polymerization of a vinyl monomer may be used without limitation. Examples of a vinyl resin unit are: acrylic acid ester resin unit, styrene-acrylic acid ester resin unit, and ethylene-vinyl acetate resin unit. These may be used alone, or may be used in combination of two or more kinds.

A forming method of a styrene-acrylic resin unit is not limited in particular. It can be cited a polymerization method to polymerize a monomer using a publicly known oil-soluble polymerization initiator or a water-soluble polymerization initiator. Specific examples of the oil-soluble polymerization initiators include the following azo-based polymerization initiators or diazo-based polymerization initiators and peroxide-based polymerization initiators.

Azo-based or diazo-based polymerization initiators are such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and Peroxide-based polymerization initiators are such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

When the resin particles are formed by the emulsion polymerization method, a water-soluble polymerization initiator can be used. Specific examples of the water-soluble polymerization initiator include: persulfates such as potassium persulfate and ammonium persulfate; azobisaminodipropane acetate; azobiscyanovaleric acid and salts thereof; and hydrogen peroxide.

(Production Method of Hybrid Crystalline Polyester Resin)

A production method of a hybrid crystalline polyester resin contained in a binder resin according to the present invention is not limited in particular as long as the production method can form a copolymer of a structure having a molecular bond between the above-described crystalline polyester resin unit and the amorphous resin unit. A specific example of a production method of a hybrid crystalline polyester resin is cited as follows.

(1) A method for producing a hybrid crystalline polyester resin having the following steps of: polymerizing an amorphous resin unit at first; forming a crystalline polyester resin unit under the presence of the amorphous resin unit.

In this method, an amorphous resin unit is formed with an addition reaction of monomers constituting the above-described amorphous resin unit (preferably, vinyl monomers such as a styrene monomer and a (meth)acrylate monomer).

Subsequently, a polyhydric alcohol component and a polycarboxylic acid component are made to polycondensed under the presence of the amorphous resin unit to form a crystalline polyester resin unit. During the moment in which a polyhydric alcohol component and a polycarboxylic acid component are made to polycondensed, the polyhydric alcohol component or the polycarboxylic acid component is made to conduct an addition reaction to the amorphous resin unit. Thus, a hybrid crystalline polyester resin is formed.

In the above-described method, it is preferable that the crystalline polyester resin unit and the amorphous resin unit each contain a portion where these two units can react with each other. Specifically, during the formation of the amorphous resin unit, in addition to the monomers constituting the amorphous resin unit, it is used a compound containing a portion which can react with a carboxy group or a hydroxy group remained in the crystalline polyester resin unit and a portion which can react with the amorphous resin unit. That is, by the reaction of this compound with a carboxy group or a hydroxy group remained in the crystalline polyester resin unit, the crystalline polyester resin unit can form a chemical bond with the amorphous resin unit.

Alternatively, during the formation of the crystalline polyester resin unit, it may use a compound which can react with the polyhydric alcohol component or the polycarboxylic acid component, with the condition that this compound has a portion which can react with the amorphous resin unit.

By using the above-described method, it can form a hybrid crystalline polyester resin having a structure of a molecular bond (a graft structure) of the amorphous resin unit bonded with the crystalline polyester resin unit.

(2) A method for producing a hybrid crystalline polyester resin having the following steps of: respectively forming a crystalline polyester resin unit and an amorphous resin unit; and making to bond these two units.

In this method, a polyhydric alcohol component and a polycarboxylic acid component are made to be polycondensed to form a crystalline polyester resin unit. Apart from a reaction system to form a crystalline polyester resin unit, an amorphous resin unit is formed by making an addition polymerization of monomers constituting the amorphous resin unit. During this reaction, it is preferable to incorporate portions which can be mutually reacted by the crystalline polyester resin unit and the amorphous resin unit. The method for incorporate such portions which can be reacted is the same as described above, therefore, the detailed explanation is omitted.

Subsequently, by making to react the above-described crystalline polyester resin unit with the amorphous resin unit, it can form a hybrid crystalline polyester resin having a structure of a molecular bond between the crystalline polyester resin unit and the amorphous resin unit.

When the above-described portions which can be reacted are not incorporated in the crystalline polyester resin unit and the amorphous resin unit, it may be formed a co-existing system of the crystalline polyester resin unit and the amorphous resin unit at first, then it may adopt a method of adding a compound having a portion which can be bonded to the crystalline polyester resin unit and the amorphous resin unit. It can from a hybrid crystalline polyester resin having a structure of a molecular bond between the crystalline polyester resin unit and the amorphous resin unit.

(3) A method for producing a hybrid crystalline polyester resin having the following steps of: forming a crystalline polyester resin unit at first; and making polymerization reaction to form an amorphous resin unit under the presence of the crystalline polyester resin unit.

In this method, a polyhydric alcohol component and a polycarboxylic acid component are made to polycondensed to form a crystalline polyester resin at first.

Subsequently, monomers constituting the amorphous resin unit are made to polymerize to form the amorphous resin unit. During this reaction, in the same manner as in the above-described method (1), it is preferable to incorporate, in the crystalline polyester resin unit and the amorphous resin unit, portions which can be mutually reacted by the crystalline polyester resin unit and the amorphous resin unit. The method for incorporate such portions which can be reacted is the same as described above, therefore, the detailed explanation is omitted.

By using the above-described method, it can form a hybrid crystalline polyester resin having a structure of a molecular bond (a graft structure) of the crystalline polyester resin unit bonded with the amorphous resin unit.

Among the production methods (1) to (3) as described above, the production method (1) is preferably used since this method enables to easily form a hybrid crystalline polyester resin having a structure of an amorphous resin unit chain bonded with a crystalline polyester resin unit as a grafted portion, and this method can simplify the production method.

The production method (1) contains the steps of forming the an amorphous resin unit at first, then making to bond a crystalline polyester resin unit. Consequently, the orientation of the crystalline polyester resin unit will be uniform. As a result, it can be securely formed a hybrid crystalline polyester resin appropriate to the toner defined in the present invention. This is a preferable embodiment.

<Coloring Agent>

For the coloring agent, various coloring agents known in the art such as dyes and pigments may be used.

As a coloring agent to prepare a black toner, it may be used various materials known in the art. Examples thereof are: carbon black such as furnace black and channel black; magnetic materials such as magnetite and ferrite; dye; inorganic pigment such as non-magnetic iron oxide.

As a coloring agent to prepare a color toner, it may be used various coloring agents known in the art such as dyes and organic pigments.

Examples of such organic pigments include: C. I. Pigment Red 5, C. I. Pigment Red 48:1, C. I. Pigment Red 53:1, C. I. Pigment Red 57:1, C. I. Pigment Red 81:4, C. I. Pigment Red 122, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222, C. I. Pigment Red 238, C. I. Pigment Red 269, C. I. Pigment Yellow 14, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, C. I. Pigment Yellow 185, C. I. Pigment Orange 31, C. I. Pigment Orange 43, C. I. Pigment Blue 15:3, C. I. Pigment Blue 60 and C. I. Pigment Blue 76.

Examples of such dyes include: C. I. Solvent Red 1, C. I. Solvent Red 49, C. I. Solvent Red 52, C. I. Solvent Red 58, C. I. Solvent Red 68, C. I. Solvent Red 11, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 69, C. I. Solvent Blue 70, C. I. Solvent Blue 93, and C. I. Solvent Blue 95.

These coloring agents may be used alone or in combination of two or more for producing the respective color toners.

The content of the coloring agent in the toner particles is preferably in the range of 1 to 10 mass parts, more preferably in the range of 2 to 8 mass parts with respect to 100 mass parts of the binder resin.

<Charge Controlling Agent>

As a charge controlling agent, a variety of well-known charge controlling agents may be added to the toner of the present invention. The content of the charge controlling agent is usually 0.1 to 5 mass parts to 100 mass parts of the binder resin.

<External Additive>

The toner mother particles of the present invention may be directly used for composing the electrostatic image developing toner of the present invention. However, in order to improve the fluidity, charging characteristics, and cleaning property, an external additive such as a so-called fluidizer and a cleaning aid may be added to the toner mother particles.

Examples of an after-treating agent are: inorganic oxide fine particles such as a silica fine particle, an alumina fine particle, and a titanium oxide fine particle; inorganic stearic acid compound fine particles such as an aluminum stearate fine particle and a zinc stearate fine particle; and inorganic titanium acid compound fine particles such as a strontium titanate fine particle and a zinc titanate fine particle. These may be used alone or in combination of two or more kinds.

These inorganic fine particles are preferably treated with a gloss treatment by using a silane coupling agent, a titanium coupling agent, a higher aliphatic acid, or a silicone oil for improving thermal storage resistance or environmental stability.

The added amount of these various external additives is preferably in the range of 0.05 to 5 mass parts, more preferably in the range of 0.1 to 3 mass parts with respect to 100 mass parts of the toner.

<Average Particle Size of Toner Particles>

It is preferable that the toner particles of the present invention have an average particle size of, for example, 3 μm to 10 μm, more preferably 5 μm to 8 μm in volume-based median diameter ($d_{50}$). The average particle size of the toner particles can be controlled by changing the concentration of the coagulant agent, the added amount of organic solvent, fusing time, the composition of the binder resin used in the production.

When the volume-based median diameter ($d_{50}$) is within the above-described range, the minute dot image of 1200 dpi level can be faithfully reproduced.

The volume-based median diameter ($d_{50}$) of the toner is measured and calculated by using measuring equipment composed of a "MULTISIZER 3" (Beckman Coulter Inc.) and a computer system installed with data processing software "Software V3.51" connected thereto. Specifically, a predetermined amount of a measuring sample (toner) is added to a predetermined amount of a surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion. The toner dispersion thus prepared is added to "ISOTON II" (Beckman Coulter Inc.) in a beaker placed in sample stand by a pipet until the concentration displayed on the measuring equipment reaches 8%. Within this concentration range, reproducible measurement values can be obtained. The measuring particle count and the aperture size of the measuring equipment are set to 25000 and 100 μm respectively. The measuring range, which is from 2 to 60 μm, is divided into 256 sections to calculate the respective frequencies. The particle size where the accumulated volume counted from the largest size reaches 50% is determined as the volume-based median diameter ($d_{50}$).

<Average Circularity of Toner Particles>

It is preferable that the toner particles in the toner of the present invention have an average circularity of 0.930 to 1.000, more preferably 0.950 to 0.995 in terms of the stability of the charging characteristics and the low-temperature fixability.

When the average circularity is within the above-described range, the individual toner particles are less crushable. This prevents the triboelectric charge applying member from smudges and stabilizes the charging characteristics of the toners. Further, high quality images can be formed.

In the present invention, the average circularity of the toner particles is a value obtained by measurement with an "FPIA-2100" (Sysmex Corp.).

Specifically, a sample (toner particles) is mixed with an aqueous solution containing a surfactant and is further dispersed by ultrasonic treatment for 1 minute. Thereafter, photographs are taken by means of the "FPIA-2100" (Sysmex Corp.) in the conditions of the HPF (high power imaging) mode at an adequate concentration corresponding to an HPF detect number of 3000 to 10000. The average circularity of the toner is calculated by determining the circularity of each toner particle according to the following Relation (I) and dividing the sum of the circularities of the individual toners by the total number of toner particles. When the HPF detect number is in the above-described range, it is reproducible.

Circularity=(Circumference of circle having same area as projected image of particle)/(Perimeter of projected image of particle) Relation (I):

(Developer)

The electrostatic image developing toner of the present invention may be used as a magnetic or non-magnetic single-component toner, or it may be used as a double-component developer by mixing with a carrier. When the toner of the present invention is used as a double-component developer, as the carrier constituting the double-component developer, there may be utilized magnetic particles composed of materials conventionally known in the art including metals such as iron, ferrite, and magnetite, or alloys of these metals with aluminum or lead. Specifically, ferrite particles are preferable.

As a carrier, there may be utilized a coated carrier prepared by coating the magnetic particles with a resin, or a resin dispersion type carrier prepared by dispersing magnetic particles in a resin.

The volume-based median diameter ($d_{50}$) of the carrier is preferably 20 to 100 μm, it is more preferably 25 to 80 μm. It is possible to determine the volume-based median diameter ($d_{50}$) of the carrier by using laser diffraction system particle size distribution meter "HELOS" (produced by SYMPATEC Co.) provided with a wet type dispersing apparatus.

<<Production Method of Electrostatic Image Developing Toner>>

<Production Method of Toner Mother Particles>

As production methods of toner mother particles according to the present, it can be cited: a suspension polymerization method, an emulsion aggregation method, and other method. Among them, it is preferable to use an emulsion aggregation method. By using this emulsion aggregation method, it can easily achieve a toner having toner particles of a small size in view of the production cost and the production stability.

The production method by the emulsion aggregation method includes the following steps. There are mixed an aqueous dispersion liquid prepared by dispersing amorphous vinyl resin fine particles in an aqueous medium and a releasing agent when needed, an aqueous dispersion liquid of coloring agent fine particles, and an aqueous dispersion liquid of crystalline polyester resin. The amorphous vinyl resin fine particles, the coloring agent fine particles, and the crystalline polyester resin are coagulated to form toner mother particles for producing an electrostatic image toner.

Here, an aqueous dispersion liquid is a material containing a dispersion element (particles) dispersed in an aqueous medium, and the aqueous dispersion liquid is composed of water as a main component (50 mass % or more).

As components other than ware, it can be cited: methanol, ethanol, isopropanol, butanol, acetone, methyl ethyl ketone, and tetrahydrofuran. Among these, alcohol type solvents such as methanol, ethanol, isopropanol, and butanol are particularly preferable, since they hardly dissolve the resin.

The amorphous vinyl resin fine particles may have a multiple layer structure having two or more layers composed of resins of different compositions. The amorphous vinyl resin fine particles having the configuration as described above can be prepared as follows, for example. The amorphous vinyl resin fine particles having a two-layered structure are prepared by the steps of: preparing a dispersion liquid of resin fine particles with a conventional polymerization method (a first step polymerization); then adding a polymerization initiator and a polymerizable monomer to the dispersion liquid and polymerizing the mixture (a second step polymerization).

As an example of a preparation method of the electrostatic image developing toner of the present invention, a preparation method by an emulsion aggregation method is described in the following.

(1) Amorphous vinyl resin fine particle preparing step of preparing amorphous vinyl resin particles that contain a releasing agent;

(2) Crystalline polyester resin fine particle dispersion preparing step in which the crystalline polyester resin is dissolved in an organic solvent, then it is dispersed in an aqueous medium to prepare an emulsion, followed by removing the organic solvent to prepare crystalline polyester resin fine particles;

(3) Coloring agent fine particle dispersion preparing step of dispersing the coloring agent in an aqueous medium to prepare a coloring agent fine particle dispersion;

(4) Core particle forming step in which core particles are formed by aggregating the amorphous vinyl resin fine particles, the coloring agent fine particles, and the crystalline polyester resin fine particles in the aqueous medium;

(5) Aging step of aging the aggregated particles by heat energy to adjust the shape, so as to prepare toner mother particles;

(6) Cooling step of cooling the toner mother particles;

(7) Filtering and washing step of separating out the toner mother particles from the cooled aqueous dispersion and removing the surfactant from the surface of the toner mother particles;

(8) Drying step of drying the washed toner mother particles.

(9) External additive adding step of adding an external additive to the dried toner mother particles.

(1) Preparing Step of Amorphous Vinyl Resin Fine Particle

In this step, an aqueous dispersion liquid of amorphous vinyl resin fine particles is prepared.

The aqueous dispersion liquid of the amorphous vinyl resin fine particles can be prepared by using a vinyl monomer to obtain the amorphous vinyl resin with a mini-emulsion polymerization method.

For example, a vinyl monomer is added to an aqueous dispersion liquid containing a surface-active agent, then, a mechanical energy is given the liquid to form liquid droplets. Subsequently, a polymerization reaction is made to proceed by radicals from a water-soluble radical polymerization initiator. The liquid droplets may contain an oil-soluble radical polymerization initiator.

(Surface-Active Agent)

As a surface-active agent usable in this step, it can be cited various known anionic surface-active agents, cationic surface-active agents, and nonionic surface-active agents.

(Polymerization Initiator)

As a polymerization initiator used in this step, any polymerization initiators known in the art may be suitably. Specific examples of the polymerization initiator include: persulfates (such as potassium persulfate and ammonium persulfate), azo compounds (4,4'-azobis-4-cyanovaleric acid and its salt, and 2,2'-azobis(2-amidinopropane) salt), peroxide compounds and azobisisobutyronitrile.

(Chain Transfer Agent)

In this step, generally known chain transfer agents may be used for the purpose of adjusting the molecular weight of the amorphous vinyl resin. The chain transfer agents are not limited in particular. Examples thereof include: 2-chloroethanol; mercaptans such as octyl mercaptan, dodecyl mercaptan, and t-dodecyl mercaptan; and a styrene dimer.

The toner mother particles according to the present invention contain a releasing agent. This releasing agent may be introduced in the toner mother particles by dissolving or dispersing in a monomer solution for producing an amorphous vinyl resin, for example.

The toner mother particles according to the present invention may further contain an internal additive such as a charge controlling agent when needed. Such internal additive may be introduced in the core particle forming step as follows. A dispersion of internal additive particles is separately prepared, and then, the internal additive particles are coagulated along with the amorphous vinyl resin fine particles, the coloring fine particles, and the crystalline polyester resin particles. However, it is preferable to introduce the internal additive in this step.

An average particle size of amorphous vinyl resin fine particles is preferably in the range of 100 to 400 nm in a volume-based median diameter ($d_{50}$). In the present invention, the volume-based median diameter ($d_{50}$) of styrene-acrylic resin fine particles is a value measured with "Microtrac UPA-150" (made by Nikkiso Co., Ltd.).

(2) Preparing Step of Crystalline Polyester Resin Fine Particles

In this step, an aqueous dispersion liquid of crystalline polyester resin fine particles is prepared.

An aqueous dispersion liquid of crystalline polyester resin fine particles can be prepared as follows. At first, a crystalline polyester resin is prepared. Then the prepared crystalline polyester resin is dispersed in an aqueous medium to be a fine particle state. Specifically, the crystalline polyester resin is dissolved or dispersed in an organic solvent to form an oil phase liquid. Then, this oil phase liquid is dispersed in an aqueous medium via phase-transfer emulsification to obtain oil droplets controlled to have a required particle size. Afterward, the organic solvent is removed to prepare the target aqueous dispersion liquid.

A preferable amount of an aqueous medium is in the range of 50 to 2,000 mass parts with respect to 100 mass parts of an oil phase liquid. More preferable amount is in the range of 100 to 1,000 mass parts. A surface-active agent may be included in the aqueous medium for the purpose of improving dispersion stability of the oil droplets. As a surface-active agent, it can be cited the same as cited in the above-described step.

As an organic solvent used for the preparation of the oil phase liquid, it is preferable that the solvent has a low boiling point and a small solubility in water from the viewpoint of easy remove after formation of the oil droplets. Specific examples are: methyl acetate, ethyl acetate, methyl ethyl ketone, methyl isobutyl ketone, toluene, and xylene.

These may be used alone or may be used in combination of two or more kinds.

An amount of an organic solvent is usually in the range of 1 to 300 mass parts with respect to 100 mass parts of a crystalline polyester resin.

An emulsion dispersion of an oil phase liquid may be done by making use of mechanical energy.

An average particle size of crystalline polyester resin fine particles is preferably in the range of 100 to 400 nm in a volume-based median diameter ($d_{50}$). In the present invention, the volume-based median diameter ($d_{50}$) of the crystalline polyester resin fine particles is a value measured with "Microtrac UPA-150" (made by Nikkiso Co., Ltd.).

(3) Preparing Step of Coloring Agent Fine Particle Aqueous Dispersion

This step is done according to necessity when a coloring agent is required to be included as toner mother particles. In this step, a coloring agent is dispersed in an aqueous medium to prepare have an aqueous dispersion of coloring agent fine particles.

The aqueous dispersion of coloring agent fine particles can be obtained by dispersing a coloring agent into an aqueous medium containing a surface-active agent in an amount of larger than a critical micelle concentration (CMC).

The dispersion of the coloring agent may be done by making use of mechanical energy. A dispersion apparatus is not limited in particular. Preferable examples thereof are: pressurized dispersing machines such as an ultrasonic dispersing machine, a mechanical homogenizer, a Manton-Gaulin homogenizer, and a pressure type homogenizer; and media type dispersing machines such as a sand grinder, a Getzman mill, and a diamond fine mill.

It is preferable that the dispersed coloring agent fine particles have a volume-based median diameter ($d_{50}$) in the range of 10 to 300 nm, more preferably in the range of 100 to 200 nm, and still more preferably in the range of 100 to 150 nm.

The volume-based median diameter ($d_{50}$) of the coloring agent fine particles is a value measured by an electrophoretic light scattering spectrometer "ELS-800" (Otsuka Electronics, Co. Ltd.).

(4) Core Particle Forming Step

In this step, core particles are formed by aggregating particles of toner constituting components: amorphous vinyl resin fine particles, coloring agent fine particles, crystalline polyester resin fine particles, and additives when needed.

Specifically, a coagulant is added to an aqueous dispersion liquid dispersed with the above-described fine particles in an amount of larger than the critical aggregation concentration. Then, the temperature of the liquid is made to be higher than the glass transition temperature (Tg) of the amorphous vinyl resin fine particles. Thus, the aggregation is done.

(Coagulant)

The coagulant used in this step is not limited in particular, but it is preferably selected from metal salts of alkali metal salts and alkali earth metal salts. Such metal salts include, for example, monovalent metal salts such as salts of sodium, potassium and lithium; divalent metal salts of calcium, magnesium, manganese and copper; and trivalent metal salts of iron and aluminum. Specific examples of such metal salts include sodium chloride, potassium chloride, lithium chloride, calcium chloride, magnesium chloride, zinc chloride, copper sulfate, magnesium sulfate, and manganese sulfate. Among them, divalent metal salts are particularly preferred since the aggregation is caused by a smaller amount. These coagulants may be used alone or in combination of two or more kinds.

(5) Aging Step

This step is done according to necessity. In this aging step, the toner mother particles obtained in the core particle forming step is aged by applying heat to change the shape of the toner mother particles into a required shape.

Specifically, this step is to heat and stir the system containing the aggregated particles to form the toner particles with a desired shape, in which the heating temperature, stirring speed and heating time are controlled so that the average circularity of the aggregated particles reaches a desired level.

(6) Cooling Step

This step is a process to cool the dispersion liquid of toner mother particles. As a condition of cooling treatment, it is preferable to cool the dispersion liquid at a cooling rate of 1 to 20° C./min. A specific cooling method is not limited in particular. It can be cited: a cooling method of introducing a coolant from outside of the reaction vessel; and a cooling method of directly introducing water into a reaction system.

(7) Filtering and Washing Step

This step is a process to remove the adhered materials such as a surface-active agent and a coagulant from the toner cake (an assembled body having a shape of a cake made of wet toner mother particles) and to wash, the toner cake being obtained by the solid-liquid separation from the cooled dispersion liquid of the toner mother particles.

A solid-liquid separation method is not limited in particular. It may be used: a centrifugation method, a reduced filtration method using an apparatus such as a Buchner funnel, a filtration method using an apparatus such as a filter press. For washing, it is preferable to wash the toner cake with water until the condition of achieving the electric conductivity of the filtrate to be 10 μS/cm.

(8) Drying Step

This step is a process to dry the washed toner cake. It may be done with a drying step in the preparation method of generally known toner mother particles.

Specific examples of a dryer used for the toner cake are: a spray drier, a vacuum freeze dryer, and a vacuum dryer. It is preferable to use an apparatus such as a static shelf dryer, a mobile shelf dryer, a fluidized bed dryer, a rotary dryer, and a stirring dryer.

A content of water in the dried toner mother particles is preferably 5 mass % or less, more preferably, it is 2 mass % or less.

When the dried toner mother particles each are aggregated by a weak particle attraction, it may be broken the aggregate. As a breaking apparatus, it may be cited: a mechanical mixing machine such as Henschel mixer, a coffee mill, and a food processor (9) External Additive Adding Step An external additive adding step is a process to add and mix an external additive to the dried toner particles according to need.

The above-described toner mother particles may be used as a toner as they are. However, it may be used by adding an external additive such as a fluidity improving agent or a cleaning aiding agent to the toner mother particles in order to improve: fluidity, charging property, and cleaning property.

As a mixing apparatus of an external additive, it may be used a mixing apparatus such as a Henschel mixer and a coffee mill.

A production method of an electrostatic image developing toner of the present invention may be any one that contains at least the above-described steps (1), (2) and (4). It may be done the steps (3) and (5) to (9) according to necessity. When the step (3) is not done, the core particles are formed by aggregating the amorphous vinyl resin fine particles and the crystalline polyester resin fine particles in the step (4).

The electrostatic image developing toner of the present invention does not have a core-shell structure. However, it may have a core-shell structure from the viewpoint of a heat resisting property. For example, it may have a shell forming step after carrying out the core particle forming step (4). In this case, it is preferable that the shell layer is made of an amorphous resin.

In addition, as a timing to add a dispersion liquid of crystalline resin, it is preferable to add the dispersion liquid during the initial stage (temperature increasing step) of the core particle forming step (4).

EXAMPLES

Hereinafter, specific examples of the present invention will be described, but the present invention is not limited thereto.

In examples of the present invention, the melting points derived from an ester wax (the first releasing agent component), a microcrystalline wax (the second releasing agent component), and the crystalline polyester resin were obtained from DSC measurement of the toner (DSC: Differential Scanning Calorimetry). The differential scanning calorimetry of the toner was conducted by using a "Diamond DSC" (PerkinElmer Inc.).

The measurement was done as follows. A sample was subjected to a first heating step of raising the temperature from room temperature (25° C.) to 150° C. at a heating rate of 10° C./min and holding the temperature at 150° C. for 5 minutes, a cooling step of decreasing the temperature from 150° C. to 0° C. at a cooling rate of 10° C./min and holding the temperature at 0° C. for 5 minutes, and a second heating step of raising the temperature from 0° C. to 150° C. at a heating rate of 10° C./min in the written order. Regarding the measuring process, 3.0 mg of the toner was sealed in an aluminum pan and it was placed in a sample holder of the "Diamond DSC". An empty aluminum pan was used for a reference.

In the above-described measurement, an endothermic curve obtained during the first heating step was analyzed. The top temperature in the endothermic peaks derived from the first and the second releasing agent components and the crystalline polyester resin, was determined as a melting point (° C.).

<<Preparation of Dispersion Liquid of Releasing Agent Particles>>

<Preparation of Dispersion Liquid (W) of Releasing Agent Particles>

The following mixture was heated to 80° C. for a releasing agent: 382.5 mass parts of behenyl behenate, 67.5 mass parts of HNP-0190 (produced by Nippon Seiro Co., Ltd.), 50 mass parts of sodium laurate, and 3,500 mass parts of water. The mixture was sufficiently dispersed with ULTRA-TURRAX T50 made by IKA Co. Ltd. Then, it was subjected to a dispersion treatment with a discharge type Gaulin homogenizer to obtain a releasing agent particle dispersion liquid (W) which contains the releasing agent fine particles having a volume-based median diameter ($d_{50}$) of 180 nm.

<<Preparation of Dispersion Liquid of Crystalline Polyester Resin Fine Particles>>

<Synthesis of Crystalline Polyester Resin>

(1) Synthesis of Crystalline Polyester Resin (c1)

Into a reaction vessel equipped with a stirrer, a nitrogen introducing device, a temperature sensor, and a cooling tube were added 200 mass parts of dodecan dicarboxylic acid and 102 mass parts of 1, 6-hexanediol. The temperature of the reaction system was raised to 190° C. over a period of 1 hour. After confirming that the reaction system was uniformly stirred, 0.3 mass parts of $Ti(OBu)_4$ was added as a catalyst, then, the temperature of the reaction system was raised from 190° C. to 240° C. over a period of 6 hours while removing the produced water. Further, with keeping the temperature at 240° C., the dehydration-condensation reaction was continued to perform polymerization. Thus it was obtained a crystalline polyester resin (c1).

The obtained crystalline polyester resin (c1) had a weight average molecular weight (Mw) of 14,500 and a melting point ($T_{mc}$) of 70° C.

(2) Synthesis of Hybrid Crystalline Polyester Resin (c2)

Raw material monomers for an addition polymerization resin (styrene-acrylic resin: StAc) unit including a bireactive monomer and a radical polymerization initiator as described below were loaded in a dropping funnel.

| | |
|---|---|
| Styrene | 34 mass parts |
| n-Butyl acrylate | 12 mass parts |
| Acrylic acid | 2 mass parts |
| Di-t-butylperoxide (polymerization initiator) | 7 mass parts |

Raw material monomers for a poly-condensation resin (crystalline polyester resin: CPEs) unit were introduced in a four-necked flask equipped with a nitrogen introducing device, a dehydration tube, a stirrer, and a thermocouple. Then, the mixture was heated to 170° C. to dissolve the content.

| | |
|---|---|
| Dodecanedicarboxylic acid | 250 mass parts |
| 1,6-Hexanediol | 128 mass parts |

Subsequently, the raw material monomers for an addition polymerization resin (styrene-acrylic resin: StAc) was dropped over a period of 90 minutes, and an aging reaction was done for 60 minutes. Then, the unreacted raw material monomers for an addition polymerization resin were removed under a reduced pressure of 8 kPa. The amount of the removed monomers was very small compared with the raw monomers for the above-described resin.

Then, 0.8 mass parts of $Ti(OBu)_4$ was added as an esterification catalyst, and the mixture was heated to 235° C. The reaction was made under a normal pressure (101.3 kPa) for 5 hours, then further the reaction was made under a reduced pressure (8 kPa).

Subsequently, the reaction mixture was cooled to 200° C., and the reaction was made under a reduced pressure (20 kPa) for 1 hour. Thus, a hybrid crystalline polyester resin (c2) was obtained.

The obtained hybrid crystalline polyester resin (c2) had a weight average molecular weight (Mw) of 18,000 and a melting point ($T_{mc}$) of 67° C.

(3) Synthesis of Hybrid Crystalline Polyester Resins (c3) and (c4)

Hybrid crystalline polyester resins (c3) and (c4) each were synthesized in the same manner as synthesis of the crystalline polyester resin (c2) except that the raw material monomers for a poly-condensation resin (crystalline polyester resin: CPEs) unit was changed to the compositions listed below.

The obtained hybrid crystalline polyester resins (c3) and (c4) each had a weight average molecular weight (Mw) of 26,200 and 22,800, and a melting point ($T_{mc}$) of 75° C. and 64° C.

Hybrid crystalline polyester resin (c3)

| | |
|---|---|
| Tetradecanedicarboxylic acid | 440 mass parts |
| 1,4-Butanediol | 153 mass parts |

Hybrid crystalline polyester resin (c4)

| | |
|---|---|
| Sebacic acid | 242 mass parts |
| 1,6-Hexanediol | 128 mass parts |

(4) Synthesis of Hybrid Crystalline Polyester Resin (c5)

Into a reaction vessel equipped with a stirrer, a nitrogen introducing device, a temperature sensor, and a cooling tube were added 275 mass parts of sebacic acid and 275 mass parts of 1,12-dodocanediol. The temperature of the reaction system was raised to 190° C. over a period of 1 hour. After confirming that the reaction system was uniformly stirred, 0.3 mass parts of $Ti(OBu)_4$ was added as a catalyst, then, the temperature of the reaction system was raised from 190° C. to 240° C. over a period of 6 hours while removing the produced water. Further, with keeping the temperature at 240° C., the dehydration-condensation reaction was continued to perform polymerization. Thus it was obtained a crystalline polyester resin (c5').

Next, the obtained crystalline polyester resin (c5') was transferred to a reaction vessel equipped with a cooling tube, a stirrer, and a nitrogen introducing device, and then, 300 mass parts of ethyl acetate and 44 mass parts of hexamethylene diisocyanate were added. The reaction was made under a nitrogen flow at 80° C. for 5 hours.

Subsequently, ethyl acetate was removed under a reduced pressure (15 kPa) to obtain a hybrid crystalline polyester resin (c5). The obtained hybrid crystalline polyester resin (c5) had a weight average molecular weight (Mw) of 52,000 and a melting point ($T_{mc}$) of 79° C.

(5) Synthesis of Crystalline Polyester Resin (c6)

Into a reaction vessel equipped with a stirrer, a nitrogen introducing device, a temperature sensor, and a cooling tube were added 148 mass parts of fumaric acid, 61 mass parts of adipic acid and 205 mass parts of 1,6-hexanediol. The temperature of the reaction system was raised to 190° C. over a period of 1 hour. After confirming that the reaction system was uniformly stirred, 0.3 mass parts of $Ti(OBu)_4$ was added as a catalyst, then, the temperature of the reaction system was raised from 190° C. to 240° C. over a period of 6 hours while removing the produced water. Further, with keeping the temperature at 240° C., the dehydration-condensation reaction was continued to perform polymerization. Thus it was obtained a crystalline polyester resin (c6).

The obtained crystalline polyester resin (c6) had a weight average molecular weight (Mw) of 20,400 and a melting point ($T_{mc}$) of 90° C.

<Preparation of Dispersion Liquid of Crystalline Polyester Resin Particles>

(1) Preparation of Dispersion Liquid (C1) of Crystalline Polyester Resin Particles 72 mass parts of the above-described crystalline polyester resin (c1) was added in 72 mass parts of methyl ethyl ketone and the mixture was stirred at 70° C. for 30 minutes to dissolve. Then, while stirring this solution, 2.5 mass parts of 25 mass % of aqueous sodium hydroxide solution was added thereto. Subsequently, a sodium polyoxyethylene lauryl ether sulfate aqueous solution in 250 mass parts of ion-exchanged water with a density of 1 mass % was added over a period of 70 minutes.

Subsequently, while keeping this emulsion at 70° C., the reaction mixture was stirred for 3 hours under a reduced pressure of 15 kPa (150 mbar) by using a diaphragm vacuum pump "V-700" (made by BUCHI Co. Ltd.). During this step, methyl ethyl ketone was removed to prepare a dispersion liquid (C1) of crystalline polyester resin particles containing fine particles of the crystalline polyester resin (c1).

A volume average particle size of the particles contained in the dispersion liquid (C1) of crystalline polyester resin particles was measured with a laser diffraction particle size distribution meter "LA-750" (made by HORIBA Co. Ltd.). It was measured to be 132 nm.

(2) Preparation of Dispersion Liquids (C2) to (C6) of Crystalline Polyester Resin Particles Dispersion liquids (C2) to (C6) of crystalline polyester resin particles each were prepared in the same manner as preparation of the dispersion liquid (C1) of crystalline polyester resin particles except that the crystalline polyester resin (c1) was respectively changed to the crystalline polyester resins (c2) to (c6).

In Table 1 described in the following, a carbon number C(acid) of the dispersion liquid (C6) of crystalline polyester resin particles indicates a carbon number of fumaric acid contained in a highest amount (mole conversion value) in C6.

TABLE 1

| Dispersion liquid No. of crystalline polyester resin fine particles | Crystalline polyester resin unit C (acid) | Crystalline polyester resin unit C (alcohol) | Amorphous resin unit Type of resin | Amorphous resin unit Content percentage [Mass %] | Melting point (Tmc) [° C.] |
|---|---|---|---|---|---|
| C1 | 12 | 6 | — | — | 70 |
| C2 | 12 | 6 | Styrene-acrylic resin | 12 | 67 |
| C3 | 14 | 4 | Styrene-acrylic resin | 8 | 75 |
| C4 | 10 | 6 | Styrene-acrylic resin | 12 | 64 |
| C5 | 10 | 12 | Urethane resin | 8 | 79 |
| C6 | 4 | 6 | — | — | 90 |

<<Preparation of Dispersion Liquid of Amorphous Resin Fine Particles>>

<Preparation of Dispersion Liquid (A1) of Amorphous Vinyl Resin Fine Particles>

(1) First Step Polymerization

Into a 5 L reaction vessel equipped with a stirrer, a temperature sensor, a cooling tube and a nitrogen introducing device, 4 mass parts of sodium polyoxyethylene-2-dodecyl ether sulfate and 3,000 mass parts of ion-exchanged water were charged. While stirring at a stirring speed of 230 rpm under nitrogen flow, the inner temperature was raised to 80° C.

After the temperature was raised, 10 mass parts of potassium persulfate (KPS) dissolved in 200 mass parts of ion-exchanged water was added thereto, and the liquid temperature was raised to 75° C. A monomer mixture composed of:

styrene (St), 568 mass parts;
n-butyl acrylate (BA), 164 mass parts; and
methacrylic acid (MAA), 68 mass parts was added thereto dropwise over 1 hour. Then, the reaction system was heated and stirred at 80° C. for 2 hours to carry out the polymerization (first step polymerization). A dispersion liquid of resin fine particles (a1) was thus prepared.

(2) Second Step Polymerization

Into a 5 L reaction vessel equipped with a stirrer, a temperature sensor, a cooling tube and a nitrogen introducing device, a solution of 2 mass parts of sodium polyoxyethylene-2-dodecyl ether sulfate dissolved in 3,000 mass parts of ion-exchanged water was charged. After heating to 80° C., 42 mass parts of the dispersion liquid of the resin fine particles (a1) and a monomer mixture composed of:

styrene (St), 195 mass parts;
n-butyl acrylate (BA), 91 mass parts;
methacrylic acid (MAA), 20 mass parts; and
n-octylmercaptan, 4.0 mass parts, and as a releasing agent, 37.8 mass parts of behenyl behenate and 16.2 mass parts of HNP-0190 were added at 80° C. thereto. The reaction system was mixed and dispersed for 1 hour by using a mechanical disperser with a circulation route "CLEARMIX" (M Technique Co., Ltd.) so that a dispersion containing emulsion particles (oil particles) was prepared.

Then, an initiator solution of 5 mass parts of potassium persulfate (KPS) dissolved in 100 mass parts of ion-exchanged water was added to the dispersion, and the system was heated and stirred at 80° C. for 1 hour to carry out polymerization (second step polymerization). A dispersion liquid of resin fine particle dispersion (a1') was thus prepared.

(3) Third Step Polymerization

A solution of 8 mass parts of potassium persulfate (KPS) dissolved in 150 mass parts of ion-exchanged water was added to the dispersion liquid of resin fine particles (a1'). A monomer mixture composed of styrene (St), 339 mass parts,
n-butyl acrylate (BA), 120 mass parts;
methacrylic acid (MAA), 32 mass parts; and
n-octylmercaptan, 8.1 mass parts, was added dropwise thereto at a temperature of over 1 hour. After the addition, the system was heated and stirred for 2 hours to carry out the polymerization (third step polymerization), and was then cooled to 28° C. The resultant dispersed amorphous vinyl resin particles (X) had a volume median particle size ($d_{50}$) of 168 nm. A dispersion liquid (A1) of amorphous vinyl resin fine particles containing a releasing agent in an aqueous medium was thus prepared.

<Preparation of Dispersion Liquids (A2) to (A4), (A7) and (A8) of Amorphous Vinyl Resin Fine Particles>

Dispersion liquids (A2) to (A4), (A7) and (A8) of amorphous vinyl resin fine particles each were prepared in the same manner as preparation of the dispersion liquids (A1) of amorphous vinyl resin fine particles except that the releasing agent was changed to the composition as described below.

| Dispersion liquids (A2) of amorphous vinyl resin fine particles | |
|---|---|
| Behenyl behenate | 38.2 mass parts |
| HNP-0190 | 55.0 mass parts |
| Dispersion liquids (A3) of amorphous vinyl resin fine particles | |
| Stearyl behenate | 79.2 mass parts |
| HNP-0190 | 14.0 mass parts |
| Dispersion liquids (A4) of amorphous vinyl resin fine particles | |
| Behenyl behenate | 79.2 mass parts |
| HNP-0190 | 14.0 mass parts |
| Dispersion liquids (A7) of amorphous vinyl resin fine particles | |
| Behenyl behenate | 35.4 mass parts |
| HNP-0190 | 57.8 mass parts |
| Dispersion liquids (A8) of amorphous vinyl resin fine particles | |
| Behenyl behenate | 92.3 mass parts |
| HNP-0190 | 0.9 mass parts |

<Preparation of Dispersion Liquid (A5) of Amorphous Vinyl Resin Fine Particles>

(1) First Step Polymerization

Into a 5 L reaction vessel equipped with a stirrer, a temperature sensor, a cooling tube and a nitrogen introducing device, 4 mass parts of sodium polyoxyethylene-2-dodecyl ether sulfate and 3,000 mass parts of ion-exchanged water were charged. While stirring at a stirring speed of 230 rpm under nitrogen flow, the inner temperature was raised to 80° C.

After the temperature was raised, 10 mass parts of potassium persulfate (KPS) dissolved in 200 mass parts of ion-exchanged water was added thereto, and the liquid temperature was raised to 75° C. A monomer mixture composed of:

styrene (St), 568 mass parts;
n-butyl acrylate (BA), 164 mass parts; and
methacrylic acid (MAA), 68 mass parts was added thereto dropwise over 1 hour. Then, the reaction system was heated and stirred at 80° C. for 2 hours to carry out the polymerization (first step polymerization). A dispersion liquid of resin fine particles (a5) was thus prepared.

(2) Second Step Polymerization

Into a 5 L reaction vessel equipped with a stirrer, a temperature sensor, a cooling tube and a nitrogen introducing device, a solution of 2 mass parts of sodium polyoxyethylene-2-dodecyl ether sulfate dissolved in 3,000 mass parts of ion-exchanged water was charged. After heating to 80° C., 39 mass parts of the dispersion of the resin fine particles (a5) and a monomer mixture composed of:

styrene (St), 180 mass parts;
n-butyl acrylate (BA), 83 mass parts;
methacrylic acid (MAA), 18 mass parts; and
n-octylmercaptan, 3.8 mass parts, and as a releasing agent, 153.7 mass parts of pentaerythrityl tetrabehenate and 28.0 mass parts of Hi-Mic-1090 were added at 85° C. thereto. The reaction system was mixed and dispersed for 1 hour by using a mechanical disperser with a circulation route "CLEARMIX" (M Technique Co., Ltd.) so that a dispersion containing emulsion particles (oil particles) was prepared.

Then, an initiator solution of 5 mass parts of potassium persulfate (KPS) dissolved in 100 mass parts of ion-exchanged water was added to the dispersion, and the system was heated and stirred at 80° C. for 1 hour to carry out polymerization (second step polymerization). A dispersion liquid of resin fine particle dispersion (a5') was thus prepared.

(3) Third Step Polymerization

A solution of 8 mass parts of potassium persulfate (KPS) dissolved in 150 mass parts of ion-exchanged water was added to the dispersion liquid of resin fine particles (a5'). A monomer mixture composed of:

styrene (St), 313 mass parts;
n-butyl acrylate (BA), 111 mass parts;
methacrylic acid (MAA), 29 mass parts; and
n-octylmercaptan, 7.5 mass parts, was added dropwise thereto at a temperature of over 1 hour. After the addition, the system was heated and stirred for 2 hours to carry out the polymerization (third step polymerization), and was then cooled to 28° C. The resultant dispersed amorphous vinyl resin particles (X) had a volume median particle size ($d_{50}$) of 194 nm. A dispersion liquid (A5) of amorphous vinyl resin fine particles containing a releasing agent in an aqueous medium was thus prepared.

<Preparation of Dispersion Liquid (A6) of Amorphous Vinyl Resin Fine Particles>

A dispersion liquid (A6) of amorphous vinyl resin fine particles was prepared in the same manner as preparation of the dispersion liquid (A5) of amorphous vinyl resin fine particles except that the releasing agent was changed to the composition as listed below.

Dispersion liquid (A6) of amorphous vinyl resin fine particles

| | |
|---|---|
| Pentaerythrityl tetrastearate | 143.2 mass parts |
| HNP-0190 | 40.4 mass parts |

<Preparation of Dispersion Liquid (A9) of Amorphous Polyester Resin Fine Particles>

(1) Preparation of Amorphous Polyester Resin (A9)

Into a four-necked flask equipped with a nitrogen introducing device, a dehydration tube, a stirrer, and a thermocouple were placed: 50 mass parts of bisphenol A ethylene oxide 2 mole adduct (BPA-EO); 249 mass parts of bisphenol A propylene oxide 2 mole adduct (BPA-PO); 91 mass parts of terephthalic acid (TPA); 46 mass parts of fumaric acid (FA); and 2 mass parts of an esterification catalyst (tin octylate). A condensation-polymerization reaction was carried out at 230° C. for 8 hours. Further, the reaction was continued under 8 kPa for 1 hour to obtain an amorphous polyester resin (a9).

(2) Preparation of Dispersion Liquid (A9) of Amorphous Polyester Resin Fine Particles 100 mass parts of amorphous polyester resin (a9) were pulverized with "Roundel Mill" (Type: RM, made by Tokuju Co. Ltd.). Then the pulverized resin was mixed with 638 mass parts of 0.26 mass % sodium lauryl sulfate solution. While stirring the mixture, it was subject to an ultrasonic dispersing treatment for 60 minutes using an ultrasonic homogenizer "US-150T" (made by Nippon Seiki Co. Ltd.) with V-LEVEL at 300 μA. Thus, it was obtained a dispersion liquid (A9) of amorphous polyester resin fine particles having a volume-based median diameter ($d_{50}$) of 160 nm.

Table 2 indicates melting points of the first and the second releasing agent components in the amorphous resin.

Thereafter, the pH was adjusted to 10 (at 25° C.) by adding 5 mol/L sodium hydroxide aqueous solution.

Thereafter, 24 mass parts (in solid fraction) of the coloring agent fine particle aqueous dispersion (Cy1) was added thereto. Then, while stirring, an aqueous solution of 60 mass parts of magnesium chloride dissolved in 60 mass parts of ion-exchanged water was added at 30° C. over a period of 10 minutes. After leaving it for 3 minutes, the temperature of the system was raised to 85° C. over a period of 60 minutes, and the temperature was held at 85° C. to allow the particle growth reaction to continue. While keeping this condition, the particle size of the aggregated particles was measured by using a "Coulter Multisizer 3" (Beckman Coulter, Inc.). When the volume median particle size reached 6.1 μm, an aqueous solution of 100 mass parts of sodium chloride dissolved in 450 mass parts of ion-exchanged water was added to terminate the particle growth. Then, the reaction system was further heated and stirred at 90° C. to allow fusion of the particles to proceed. When the average circularity of the toner reached 0.945, the reaction system was cooled to 30° C. at a cooling rate of 25° C./min.

TABLE 2

| Dispersion liquid No. of amorphous resin fine particles | Type of resin | Composition | Releasing agent: First releasing agent component (Ester wax) Type | Melting point (Tmw1) [° C.] | Second releasing agent component (Microcrystalline wax) Type | Melting point (Tmw2) [° C.] |
|---|---|---|---|---|---|---|
| A1 | Styrene-acrylic resin | St/BA/MAA | Behenyl behenate | 71 | HNP-0190 | 83 |
| A2 | Styrene-acrylic resin | St/BA/MAA | Behenyl behenate | 71 | HNP-0190 | 83 |
| A3 | Styrene-acrylic resin | St/BA/MAA | Stearyl behenate | 67 | HNP-0190 | 83 |
| A4 | Styrene-acrylic resin | St/BA/MAA | Behenyl behenate | 71 | HNP-0190 | 83 |
| A5 | Styrene-acrylic resin | St/BA/MAA | Pentaerythrityl tetrabehenate | 84 | Hi-Mic-1090 | 88 |
| A6 | Styrene-acrylic resin | St/BA/MAA | Pentaerythrityl tetrastearate | 76 | HNP-0190 | 83 |
| A7 | Styrene-acrylic resin | St/BA/MAA | Behenyl behenate | 71 | HNP-0190 | 83 |
| A8 | Styrene-acrylic resin | St/BA/MAA | Behenyl behenate | 71 | HNP-0190 | 83 |
| A9 | Amorphous polyester resin | BPA-E0, BPA-P0/FA, TPA, TMA | — | — | — | — |

<<Preparation of Aqueous Dispersion Liquid of Coloring Particles>>

<Preparation of Aqueous Dispersion Liquid (Cy1) of Coloring Particles>

90 mass parts of sodium dodecyl sulfate were added to 1,600 mass parts of ion-exchanged water. While stirring the solution, 420 mass parts of copper phthalocyanine (C. I. Pigment Blue 15:3) were gradually added thereto. Then, the mixture was subjected to a dispersing treatment using a disperser "CLEARMIX" (M Technique Co., Ltd.). An aqueous dispersion liquid (Cy1) of coloring particles was thus prepared. The prepared aqueous dispersion liquid (Cy1) of coloring particles had a volume-based median diameter ($d_{50}$) of 110 nm.

<<Preparation of Toner>>

<Preparation of Toner (1)>

Into a reaction vessel equipped with a stirrer, a temperature sensor and a cooling tube, 137 mass parts (in solid fraction) of the amorphous vinyl resin fine particle aqueous dispersion (A1), 274 mass parts (in solid fraction) of the amorphous polyester resin fine particle aqueous dispersion (A9), 46 mass parts (in solid fraction) of the crystalline polyester resin fine particle aqueous dispersion (C1) and 2,000 mass parts of ion-exchanged water were charged. The average circularity of the toner was measured by a measuring apparatus "FPIA-2100" (Sysmex Corp.) (HPF detect number of 4000).

Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield toner particles.

To 100 mass parts of the obtained toner particles, 1.6 mass parts of hydrophobic silica (number average primary particle size=12 nm, hydrophobicity=68) and 0.6 mass parts of hydrophobic titanium oxide (number average primary particle size=20 nm, hydrophobicity=63) were added, and the mixture was mixed for 20 minutes by using a "Henschel mixer" (Mitsui Mike Machinery Co., Ltd.) in the condition of a rotary blade circumferential speed of 35 mm/sec. Thus there were prepared toner (1) having a volume average particle size of 6.1 μm.

<Preparation of Toners (2) to (9) and (11) to (14)>

Toners (2) to (9) and (11) to (14) each were prepared in the same manner as preparation of the toner (1) except that an aqueous dispersion liquid of amorphous resin fine particles and aqueous dispersion liquid of crystalline polyester resin fine particles were changed as described in Table 3.

<Preparation of Toner (10)>

Into a reaction vessel equipped with a stirrer, a temperature sensor and a cooling tube, 374 mass parts (in solid fraction) of the amorphous polyester resin fine particle dispersion (A9), 46 mass parts (in solid fraction) of the crystalline polyester resin fine particle aqueous dispersion (C1), 37 mass parts of the releasing agent fine particle dispersion (W), and 2,000 mass parts of ion-exchanged water were charged. Thereafter, the pH was adjusted to 10 (at 25° C.) by adding 5 mol/L sodium hydroxide aqueous solution.

Thereafter, 24 mass parts (in solid fraction) of the coloring agent fine particle aqueous dispersion (Cy1) was added thereto. Then, while stirring, an aqueous solution of 60 mass parts of magnesium chloride dissolved in 60 mass parts of ion-exchanged water was added at 30° C. over a period of 10 minutes. After leaving it for 3 minutes, the temperature of the system was raised to 85° C. over a period of 60 minutes, and the temperature was held at 85° C. to allow the particle growth reaction to continue. While keeping this condition, the particle size of the aggregated particles was measured by using a "Coulter Multisizer 3" (Beckman Coulter, Inc.). When the volume median particle size reached 6.0 μm, an aqueous solution of 100 mass parts of sodium chloride dissolved in 450 mass parts of ion-exchanged water was added to terminate the particle growth. Then, the reaction system was further heated and stirred at 90° C. to allow fusion of the particles to proceed. When the average circularity of the toner reached 0.945, the reaction system was cooled to 30° C. at a cooling rate of 25° C./min.

Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield toner particles.

To 100 mass parts of the obtained toner particles, 1.6 mass parts of hydrophobic silica (number average primary particle size=12 nm, hydrophobicity=68) and 0.6 mass parts of hydrophobic titanium oxide (number average primary particle size=20 nm, hydrophobicity=63) were added, and the mixture was mixed for 20 minutes by using a "Henschel mixer" (Mitsui Miike Machinery Co., Ltd.) in the condition of a rotary blade circumferential speed of 35 mm/sec. Thus there were prepared toner (10) having a volume average particle size of 6.1 μm.

TABLE 3

| | Binder resin | | | | | | | Releasing agent | |
|---|---|---|---|---|---|---|---|---|---|
| | Dispersion liquid of amorphous resin fine particles | | Dispersion liquid of crystalline polyester resin fine particles | | | Content | | First releasing agent component | |
| Toner No. | Dispersion liquid No. | Content [Mass part] | Dispersion liquid No. | Content [Mass part] | Melting point (Tmc) [° C.] | Content percentage of vinyl resin [Mass %] | Content percentage of crystalline polyester resin [Mass %] | Content percentage [Mass %] | Melting point (Tmw1) [° C.] |
| 1 | A1/A9 | 219/192 | C1 | 46 | 70 | 45.4 | 10.3 | 70 | 71 |
| 2 | A2/A9 | 269/160 | C2 | 27 | 67 | 56.4 | 6.4 | 41 | 71 |
| 3 | A3 | 419 | C2 | 37 | 67 | 91.2 | 8.8 | 85 | 67 |
| 4 | A4 | 410 | C4 | 46 | 64 | 89.0 | 11.0 | 85 | 71 |
| 5 | A4 | 410 | C3 | 46 | 75 | 89.0 | 11.0 | 85 | 71 |
| 6 | A5 | 378 | C3 | 78 | 75 | 80.2 | 19.8 | 97 | 84 |
| 7 | A6 | 429 | C3 | 27 | 75 | 92.9 | 7.1 | 78 | 76 |
| 8 | A4 | 392 | C5 | 64 | 79 | 84.7 | 15.3 | 85 | 71 |
| 9 | A4 | 392 | C6 | 64 | 90 | 84.7 | 15.3 | 85 | 71 |
| 10 | A9 | 374 | C1 | 46 | 70 | 0 | 10.9 | 85 | 71 |
| 11 | A4 | 443 | C1 | 46 | 70 | 96.9 | 3.1 | 85 | 71 |
| 12 | A4 | 356 | C1 | 46 | 70 | 76.1 | 23.9 | 85 | 71 |
| 13 | A7 | 410 | C1 | 46 | 70 | 89.0 | 11.0 | 38 | 71 |
| 14 | A8 | 410 | C1 | 45 | 70 | 89.0 | 11.0 | 99 | 71 |

| | Releasing agent | | | | | |
|---|---|---|---|---|---|---|
| | Second releasing agent component | | | Difference of melting points | | |
| Toner No. | Content percentage [Mass %] | Melting point (Tmw2) [° C.] | Content percentage in toner [Mass %] | $T_{mw2} - T_{mw1}$ [° C.] | $T_{mw2} - T_{mc}$ [° C.] | Remarks |
| 1 | 30 | 83 | 2.7 | 12 | 13 | Present invention |
| 2 | 59 | 83 | 5.6 | 12 | 16 | Present invention |
| 3 | 15 | 83 | 8.7 | 16 | 16 | Present invention |
| 4 | 15 | 83 | 8.6 | 12 | 19 | Present invention |
| 5 | 15 | 83 | 8.6 | 12 | 8 | Present invention |
| 6 | 3 | 88 | 13.2 | 4 | 8 | Present invention |
| 7 | 22 | 83 | 15.2 | 7 | 8 | Present invention |
| 8 | 15 | 83 | 8.2 | 12 | 4 | Present invention |
| 9 | 15 | 83 | 8.2 | 12 | −7 | Present invention |

TABLE 3-continued

| | | | | | | |
|---|---|---|---|---|---|---|
| 10 | 15 | 83 | 8.0 | 12 | 13 | Comparative example |
| 11 | 15 | 83 | 9.2 | 12 | 13 | Comparative example |
| 12 | 15 | 83 | 7.5 | 12 | 13 | Comparative example |
| 13 | 62 | 83 | 8.6 | 12 | 13 | Comparative example |
| 14 | 1 | 83 | 8.6 | 12 | 13 | Comparative example |

<<Preparation of Developer>

A ferrite carrier covered with a silicone resin and having a volume average particle size of 60 μm was added to toners (1) to (14) so that the content of the toner particles became to be 6 mass %. The mixtures were each mixed to prepare developers (1) to (14).

<<Evaluation>>

<Low-Temperature Fixability>

In a multi-function printer "bizhub PRO™ C6501" (made by Konica Minolta, Inc.), the fixing device was modified in such a manner that the surface temperature of the heat roller for fixing was adjustable in the range of 100 to 210° C. The above-described toners were respectively charged to the printer. As a paper for evaluation, "NPi high-quality paper" (128 g/m$^2$) (made by Nippon Paper Co. Ltd.) was used. A fixing test was repeatedly conducted to fix a solid image having an amount of adhered toner of 8 mg/10 cm$^2$ under the condition of normal temperature (20° C., relative humidity of 55%) by gradually increasing the fixing temperature from 95° C. to 200° C. with a step of 5° C.

Subsequently, each of the printed matters obtained in the fixing test at different temperatures was folded by a folding machine so that a load is applied to the solid image, and air compressed at a pressure of 0.35 MPa is blown to the formed crease. The condition of the crease was ranked into 5 grades as described in the following evaluation criteria.

Rank 5: No peel-off is observed at the crease.

Rank 4: A partial peel-off is found along the crease.

Rank 3: A narrow linear peel-off is found along the crease.

Rank 2: A bold linear peel-off is found along the crease.

Rank 1: A large peel-off is found in the image.

Among the fixing tests having acquired Rank 3, the lowest fixing temperature in the fixing tests was taken as the lowest fixing temperature. And it was evaluated according to the following criteria. The evaluation classes of A, B and C were in the category of passing an examination.

The evaluation results are listed in Table 4.

A: The lowest fixing temperature is not more than 150° C.

B: The lowest fixing temperature is larger than 150° C. and not more than 160° C.

C: The lowest fixing temperature is larger than 160° C. and not more than 180° C.

D: The lowest fixing temperature is larger than 180° C.

<High-Temperature Offset Resistivity>

In a multi-function printer "bizhub PRO™ C6501" (made by Konica Minolta, Inc.), the fixing device was modified in such a manner that the surface temperature of the heat roller for fixing was adjustable in the range of 100 to 210° C. The above-described toners were respectively charged to the printer. As a paper for evaluation, plain paper "J-Paper" (64 g/m$^2$) (made by Konica Minolta, Inc.) was used. A fixing test was repeatedly conducted to fix a solid image having an amount of adhered toner of 8 mg/10 cm$^2$ under the condition of normal temperature (20° C., relative humidity of 55%) by gradually increasing the fixing temperature from 150° C. to 210° C. with a step of 5° C. The phenomenon of offset was visually evaluated. The evaluation classes of A and B were in the category of passing an examination.

The evaluation results are listed in Table 4.

A: Offset is not observed until 200° C.

B: Offset is observed at higher than 180° C. to not more than 200° C.

C: Offset is observed at not more than 180° C.

<Fixing-Separation Property>

In a multi-function printer "bizhub PRO™ C6501" (made by Konica Minolta, Inc.), the fixing device was modified in such a manner that the surface temperature of the heat roller for fixing was adjustable in the range of 100 to 210° C. The above-described toners were respectively charged to the printer. The surface temperature of the heat roller for fixing was set to be 190° C. On an A4 size recording sheet "OK Print High-quality" (52.3 g/m$^2$) (made by Oji Paper Co. Ltd.) was fixed a solid image of 10 cm width having an amount of adhered toner of 8 mg/10 cm$^2$, the solid image extending to an axis direction of the heat roller under the condition of normal temperature (20° C., relative humidity of 55%). The separation property of the solid image was evaluated according to the following evaluation criteria. The evaluation classes of A and B were in the category of passing an examination.

The evaluation results are listed in Table 4.

A: The recording sheet is not curled, and it can be separated from the heat roller. The formed image is not deteriorated.

B: The recording sheet can be separated from the heat roller. A white stripe is observed on the formed image.

C: The recording sheet is wound around the heat roller. The recording sheet cannot be separated from the heat roller.

<Gloss Unevenness>

In a multi-function printer "bizhub PRO™ C6501" (made by Konica Minolta, Inc.), the fixing device was modified in such a manner that the surface temperature of the heat roller for fixing was adjustable in the range of 100 to 210° C. The above-described toners were respectively charged to the printer. The surface temperature of the heat roller for fixing was set to be 190° C. On a paper "Gloss coat paper" (128 g/m$^2$) (made by Oji Paper Co. Ltd.) was fixed a solid image having an amount of adhered toner of 8 mg/10 cm$^2$ under the condition of normal temperature (20° C., relative humidity of 55%). The difference of glossiness (Gloss Difference) between the maximum glossiness and the minimum glossiness in the fixed image was calculated. The Gloss Difference was evaluated according to the following evaluation criteria. The evaluation classes of A, B and C were in the category of passing an examination.

The evaluation results are listed in Table 4.

A: Gloss Difference≤3 (The difference of glossiness between the maximum glossiness and the minimum glossiness cannot be recognized)

B: 3<Gloss Difference≤8 (The difference of glossiness between the maximum glossiness and the minimum glossiness is slightly recognized. The difference does not cause a practical problem.)

C: 8<Gloss Difference≤15 (The difference of glossiness between the maximum glossiness and the minimum glossiness is recognized. The difference does not cause a practical problem.)

D: 15<Gloss Difference (The difference of glossiness between the maximum glossiness and the minimum glossiness is distinctly recognized. The difference causes a practical problem.)

TABLE 4

| Toner No. | Low-temperature fixability: Lowest fixing temperature [° C.] | Rank | High-temperature offset resistivity: Generation temperature [° C.] | Rank | Fixing-separation property | Gloss unevenness | Remarks |
|---|---|---|---|---|---|---|---|
| 1 | 150 | A | 190 | B | A | A | Present invention |
| 2 | 170 | C | 190 | B | A | B | Present invention |
| 3 | 150 | A | No generation | A | A | A | Present invention |
| 4 | 150 | A | No generation | A | B | C | Present invention |
| 5 | 160 | B | 190 | B | B | A | Present invention |
| 6 | 150 | A | 200 | B | A | B | Present invention |
| 7 | 160 | B | No generation | A | A | C | Present invention |
| 8 | 170 | C | No generation | A | A | B | Present invention |
| 9 | 180 | C | No generation | A | A | C | Present invention |
| 10 | 160 | B | 170 | C | C | B | Comparative example |
| 11 | 190 | D | No generation | A | B | B | Comparative example |
| 12 | 150 | A | 190 | B | B | D | Comparative example |
| 13 | 190 | D | No generation | A | A | C | Comparative example |
| 14 | 170 | C | 200 | B | B | D | Comparative example |

As can be seen from the results in Table 4, the toners of the present invention were found to be excellent in low-temperature fixability, high-temperature offset resistivity, fixing-separation property and gloss uniformity.

From these results, it was confirmed that the toner having the following composition is effective to provide an electrostatic image toner excellent in fixing-separation property and gloss uniformity with keeping low-temperature fixability and high-temperature offset resistivity. The toner includes: a first releasing agent component containing an ester wax and a second releasing agent component containing a microcrystalline wax, wherein a content of the first releasing agent component in the releasing agent is in the range of 40 to 98 mass %; a content of the second releasing agent component in the releasing agent is in the range of 2 to 60 mass %; and a content of the crystalline polyester resin in the binder resin is in the range of 5 to 20 mass %.

What is claimed is:

1. An electrostatic image developing toner comprising toner mother particles containing a binder resin and a releasing agent, wherein the binder resin contains an amorphous vinyl resin and a crystalline polyester resin;

the releasing agent contains a first releasing agent component containing an ester wax and a second releasing agent component containing a microcrystalline wax;

a content of the first releasing agent component in the releasing agent is in the range of 40 to 98 mass %;

a content of the second releasing agent component in the releasing agent is in the range of 2 to 60 mass %;

a content of the crystalline polyester resin in the binder resin is in the range of 5 to 20 mass %; and a content of the amorphous vinyl resin in the binder resin is 50 mass % or more.

2. The electrostatic image developing toner of claim 1, wherein a melting point ($T_{mc}$) of the crystalline polyester resin satisfies Relation (1):

$$65(°\ C.) \leq T_{mc} \leq 85(°\ C.).$$

3. The electrostatic image developing toner of claim 1, wherein a melting point ($T_{mw1}$) of the first releasing agent component and a melting point ($T_{mw2}$) of the second releasing agent component satisfy Relation (2):

$$5(°\ C.) \leq T_{mw2} - T_{mw1} \leq 15(°\ C.).$$

4. The electrostatic image developing toner of claim 1, wherein a melting point ($T_{mc}$) of the crystalline polyester resin and a melting point ($T_{mw2}$) of the second releasing agent component satisfy Relation (3):

$$5(°\ C.) \leq T_{mw2} - T_{mc} \leq 15(°\ C.).$$

5. The electrostatic image developing toner of claim 1, wherein a content of the releasing agent in the toner mother particles is in the range of 3 to 15 mass %.

6. The electrostatic image developing toner of claim 1, wherein the first releasing agent component contains a plurality of ester compounds each having a different carbon chain length; and a content of the ester compound having a carbon chain length corresponding to a highest content in a distribution of the carbon chain length of the first releasing agent component is 70 mass % or more.

7. The electrostatic image developing toner of claim 1, wherein the crystalline polyester resin is a hybrid crystalline polyester resin having a chemical bond between a crystalline polyester resin unit and an amorphous resin unit other than a polyester resin.

8. The electrostatic image developing toner of claim 7, wherein the amorphous resin unit is a vinyl resin unit.

* * * * *